US011647829B2

(12) United States Patent
Kim

(10) Patent No.: US 11,647,829 B2
(45) Date of Patent: May 16, 2023

(54) CARRYING CASE WITH PARTIALLY-DETACHABLE TRAPEZOIDALLY ELONGATED BELT LOOP PORTION

(71) Applicant: Tae Moon Kim, Arlington, VA (US)

(72) Inventor: Tae Moon Kim, Arlington, VA (US)

( * ) Notice: Subject to any disclaimer, the term of this patent is extended or adjusted under 35 U.S.C. 154(b) by 0 days.

(21) Appl. No.: 17/819,596

(22) Filed: Aug. 12, 2022

(65) Prior Publication Data

US 2023/0051476 A1 Feb. 16, 2023

(30) Foreign Application Priority Data

Aug. 13, 2021 (KR) ..... 10-2021-0107477

(51) Int. Cl.
*A45F 5/02* (2006.01)

(52) U.S. Cl.
CPC ..... *A45F 5/021* (2013.01)

(58) Field of Classification Search
CPC ..... A45F 5/021; A45F 2200/0516; Y10S 224/93; A45C 11/04; A45C 13/1076; A45C 13/36; A45C 7/0054
USPC ..... 224/677, 236, 930
See application file for complete search history.

(56) References Cited

U.S. PATENT DOCUMENTS 2,049,293 A * 7/1936 Fink ..... F41C 33/0227 224/675
3,212,690 A * 10/1965 Green ..... A41F 9/002 224/675
3,583,612 A * 6/1971 Theodore ..... F41C 33/048 224/675
3,938,716 A * 2/1976 Jackson ..... A45F 4/02 D3/217
4,303,187 A * 12/1981 Berman ..... A45F 5/021 224/684
4,356,943 A * 11/1982 Berman ..... A45F 5/021 D3/230

(Continued)

FOREIGN PATENT DOCUMENTS

JP 2002272525 A 9/2002
KR 960001676 Y1 2/1996

(Continued)

OTHER PUBLICATIONS

Office Action issued in KR Application No. 10-2021-0107477, NPL Year 2021.

*Primary Examiner* — Adam J Waggenspack
(74) *Attorney, Agent, or Firm* — Cybernetic Law PLLC; John Hocker

(57) ABSTRACT

A carrying case including a main body housing providing a storage space, an opening to the storage space, a movable part or flap, a partially-detachable loop portion, and at least one fastening means. The partially-detachable loop portion has a first end that is fixedly-attached to the main body housing, and a second end that is attachable/detachable to the main body housing by the fastening means. In a fully-attached state, the fastening means holds the second end of the partially-detachable loop portion to an outer surface of the main body housing until the at least one fastening means is released, the releasing allowing a partially-detachable loop portion to move to a partially-attached state where the second end freely moves.

18 Claims, 18 Drawing Sheets

(56) References Cited

U.S. PATENT DOCUMENTS

| | | | | | |
|---|---|---|---|---|---|
| 4,467,946 | A * | 8/1984 | Brown | A45C 11/24 | 206/349 |
| 4,496,088 | A * | 1/1985 | Tuthill | A45F 5/02 | 224/232 |
| 4,917,160 | A * | 4/1990 | Hart | A45C 15/00 | 224/675 |
| 6,003,663 | A * | 12/1999 | Newcomer | A45C 11/046 | 206/5 |
| 6,182,878 | B1 * | 2/2001 | Racca | H04B 1/3888 | 224/604 |
| 6,478,205 | B1 * | 11/2002 | Fujihashi | A45F 5/02 | 224/675 |
| 6,568,576 | B1 * | 5/2003 | Godshaw | A45F 5/00 | 224/655 |
| 7,597,225 | B2 * | 10/2009 | Badillo | G03B 17/566 | 224/675 |
| 2007/0023471 | A1 * | 2/2007 | Garcia | B25H 3/006 | 224/904 |
| 2008/0127461 | A1 | 6/2008 | Linden | | |
| 2009/0127304 | A1 | 5/2009 | Uygur | | |

FOREIGN PATENT DOCUMENTS

| | | | |
|---|---|---|---|
| KR | 20150001252 | U | 3/2015 |
| KR | 102363442 | B1 | 2/2022 |

* cited by examiner

CARRYING CASE WITH PARTIALLY-DETACHABLE TRAPEZOIDALLY ELONGATED BELT LOOP PORTION

CROSS-REFERENCE TO RELATED APPLICATIONS

This application is based on and claims priority from Korean Patent Application No. 10-2021-0107477, filed on Aug. 13, 2021, in the Korean Intellectual Property Office, the entire disclosure of which is incorporated herein by reference in its entirety.

BACKGROUND OF THE INVENTION

1. Field

Exemplary embodiments relate to a carrying case worn on a belt by a user, the carrying case securely storing a physical object/article (e.g., eyeglasses, a smartphone). More particularly, exemplary embodiments relate to a carrying case and a mechanism for maintaining and stabilizing attachment of the carrying case to a user's body (e.g., a user's waist belt) while providing an improved attachment/detachment process.

2. Description of the Related Art

Various carrying cases are generally available. For example, eyeglasses/sunglasses cases safely store eyeglasses or sunglasses. Eyeglasses/sunglasses cases are formed in various types depending on the material, and are manufactured and marketed to correspond to a corresponding size for storing eyeglasses and/or sunglasses.

Recently, to prevent theft or loss of the carrying case, a belt-wearing carrying case capable has been used. Conventional eyeglasses carrying cases (or sunglasses carrying cases) may be worn on a waist belt. Wearing the carrying case on the wait belt provides convenience for everyday activities (e.g., walking, jogging, hiking, running, climbing, working, biking, driving, skiing, fishing, or other indoor or outdoor activities).

Conventional glasses carrying cases include four types of wearing-on-belt cases, including carabiner, clip, loop, or clip and loop. However, the carabiner type has a problem in that it swings and wobbles while moving and thus is not stabilized. In addition, the carabiner type does not have single hand operation while moving. Two hands are needed to take out and put the glasses back into the carrying case, and it is very difficult, if not impossible to do so with one hand.

The clip-on belt type has a problem of being not stabilized as it is slippery and slides easily (e.g., moves up and down, and/or back and forth). The fixed loop on belt type has a problem in that the belt passes through the fixed loop on the case, and the fixed loop on belt type requires a burdensome process including removing the belt from the pants, taking off case from the belt, and then putting the belt back on the pants. The fixed loop method is inconvenient, time-consuming, and impractical as it may be inappropriate to remove a belt in a public setting. The loop and clip belt type includes the loop type and the clip type, but it still can be slippery and slide easily in the clip mode and has the burdensome removal process in the loop mode (as described above).

The above information is presented as background information only to assist with an understanding of the disclosure. No determination has been made, and no assertion is made, as to whether any of the above might be applicable as prior art regarding the disclosure.

SUMMARY

Aspects of the disclosure are to address at least the above-mentioned problems and/or disadvantages and to provide at least the advantages described below. Accordingly, an aspect of the disclosure is to provide a carrying case including a main body housing providing a storage space within the main body housing. The housing may provide an opening to make the storage space accessible. The carrying case may include a movable part or flap attached to or integrally provided by the main body housing, and at least one partially-detachable loop portion attached to the main body housing on an outer surface of the main body housing.

The movable part or flap may be configured to move between an open position and a closed position. The storage space may be accessible from the outside when the movable part or flap is in the open position, and an object placed within the storage space may be prevented from leaving the storage space when the movable part or flap is in the closed position. The carrying case may further comprise at least one fastening means. Each of the at least one partially-detachable loop portion may include a fastening means and a number of fastening means of the at least one fastening means may correspond to a number of respective partially-detachable loop portions.

Each of the at least one partially-detachable loop portion may have a first end that is fixedly-attached to the main body housing and may be in an attached position outside of the storage space, and may be provided outside of the main body housing at an outer surface of the main body housing. Each of the at least one partially-detachable loop portion may include a second end that is attachable/detachable to the main body housing by way of the respective one of the at least one fastening means. Each of the at least one fastening means may be attachable/detachable to a corresponding fastening means provided on an outer surface of the main body housing, such as by an operation using one human or animal hand. In a fully-attached state, the at least one fastening means may hold the second end of the at least one partially-detachable loop portion to an outer surface of the main body housing until the at least one fastening means is released, the releasing allowing a partially-detachable loop portion to move to a partially-attached state where the second end freely moves.

According to an embodiment, the respective first end of each of the at least one partially-detachable loop portion and the respective second end of each of the at least one partially-detachable loop portion may be provided on a same side of the outer surface of the main body housing. According to an embodiment, the partially-detachable loop portion may be configured to be held by a belt outside of the storage space when the partially-detachable loop portion is in the fully-attached state or the partially-attached state, and each of the at least one partially-detachable loop portion may surround a belt strap of the belt when the partially-detachable loop portion is in the fully-attached state.

According to an embodiment, the at least one partially-detachable loop comprises two partially-detachable loop portions. According to an embodiment, the two partially-detachable loop portions are spaced apart such that a belt loop of pants can fit between the two partially-detachable loop portions. According to an embodiment, the belt loop is configured to prevent the belt from falling.

According to an embodiment, the at least one partially-detachable loop comprises at least one belt loop configured to hold a belt in place around a human's waist. According to an embodiment, the at least one partially-detachable loop portion comprises two partially-detachable loop portions, and the at least one partially-detachable loop portion comprises at least one belt partially-detachable loop portion configured to hold and/or be held by a belt around a human's waist. According to an embodiment, the carrying case of Claim 1, the at least one fastening means comprise at least one of: a button, Velcro®, a magnet or an object that is attachable to a button, Velcro® or a magnet. According to an embodiment, the at least one fastening means comprises a button coupling structure including a first fastening means portion corresponding to a male button or a female button, and a second fastening means portion on the outer surface of the main body housing. According to an embodiment, the second fastening means portion comprises the other one of the male button or the female button.

According to an embodiment, the at least one partially-detachable loop portion comprises two partially-detachable loop portions. According to an embodiment, the at least one partially-detachable loop portion visually blends in aesthetically with at least one of the color or surface texture of the outer surface of the main body housing. According to an embodiment, the carrying case further comprises eyeglasses or a smartphone stored in the storage space. According to an embodiment, inner surfaces of the storage space within the main body housing are configured to hold the eyeglasses or smartphone while preventing the eyeglasses or smartphone from leaving the storage space. According to an embodiment, the opening to the storage space is fitted and configured to allow vertical entry and exit of the eyeglasses or smartphone into the storage space.

According to an embodiment, the opening to the storage space is fitted and configured to allow horizontal entry and exit of the eyeglasses or smartphone into the storage space. According to an embodiment, the first end of the at least one fastening means is integrally provided with the housing main body. According to an embodiment, in the fully-attached state, the at least one partially-detachable loop portion closing a loop around a belt strap of a belt outside of the storage space.

According to an embodiment, the carrying case of Claim 1, wherein the at least one partially-detachable loop portion comprises a reinforcing part that prevents shape deformation of the partially-detachable loop portion. According to an embodiment, the reinforcing part comprises a sewing reinforcement structure that is at least one of: stapled, glued, and/or sewn, and/or a stich pattern, the stitch pattern being a straight stitch pattern, or a zigzag stitch pattern.

According to an embodiment, one or more of the at least one partially-detachable loop portion is flexible, and has a trapezoidally-elongated shape that grows narrower from the first end to the second end to stabilize the storage space to prevent shaking of any contents within the storage space, and to prevent twisting of the at least one partially-detachable loop portion. According to an embodiment, the second end is attachable/detachable to the outer surface of the main body housing to close the loop. According to an embodiment, the one or more of the at least one partially-detachable loop portion is made of a leather, a synthetic leather material or a nylon canvas.

According to an aspect of an embodiment, there is provided a carrying case main body including a housing providing a storage space within the carrying case main body, a movable part attached to the housing, at least one loop portion attached to the housing on an outer surface of the housing; and a part of an attachable/detachable fastening means attached to one end of each of the at least one loop portion.

According to an embodiment, the housing provides an opening to make the storage space accessible. According to an embodiment, the movable part is configured to move between an open position and a closed position. According to an embodiment, the storage space is accessible from the outside when the movable flap is in the open position. According to an embodiment, an article placed within the housing is prevented from leaving the storage space when the movable part is in the closed position. According to an embodiment, a first end of the at least one loop portion is fixedly-attached to the outer surface of the housing.

According to an embodiment, a second end of the at least one loop portion is attachable/detachable to a fastening means provided on the outer surface of the housing to hold the second end of a respective loop portion in an attached position where the loop portion is configured to be held by a belt when the loop portion is in the attached position and the respective loop portion surrounds a belt strap of the belt.

According to an aspect of an embodiment, there is provided a carrying case including a main body housing providing a storage space within the main body housing, where the main body housing provides an opening to make the storage space accessible, a movable part or flap attached to or integrally provided by the main body housing, and at least one partially-detachable loop portion attached to the main body housing on an outer surface of the main body housing. According to an embodiment, the movable part or flap is configured to move between an open position and a closed position.

According to an embodiment, the storage space is accessible from the outside when the movable part or flap is in the open position. According to an embodiment, an object placed within the main body housing is prevented from leaving the storage space when the movable part or flap is in the closed position. According to an embodiment, a first fastener of a fastening coupling structure is fixedly attached to an end of each of the at least one partially-detachable loop portion. According to an embodiment, a second fastener of the fastening coupling structure is fixedly attached to the outer surface of the main body housing.

BRIEF DESCRIPTION OF DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION OF THE INVENTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness. The terminology used herein is for the purpose of referring to specific embodiments only, and is not intended to limit the invention.

The terms and words used in the following description and claims are not limited to the bibliographical meanings, but are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents. Unless defined otherwise, all terms including technical and scientific terms used herein have the same meaning as commonly understood by those of ordinary skill in the art to which the present invention belongs. Commonly used terms defined in a dictionary are additionally interpreted as having a meaning consistent with the related technical literature and the presently disclosed content, and unless defined, are not interpreted in an ideal or very formal meaning.

As used herein, the singular forms "a," "an," and "the" include the plural forms unless the context clearly indicates otherwise. Thus, for example, reference to "an element" includes reference to one or more of such elements. The meaning of "comprising," as used herein, specifies a particular characteristic, region, integer, step, operation, element and/or component, and other specific characteristic, region, integer, step, operation, element, component, and/or group. It does not exclude the existence or addition of anything.

With reference to the accompanying drawings, the embodiments of the disclosure will be described in detail so that those of ordinary skill in the art can easily carry out the embodiments. However, the inventive concepts may be embodied in several different forms and is not limited to the embodiments described herein.

Figure 1:
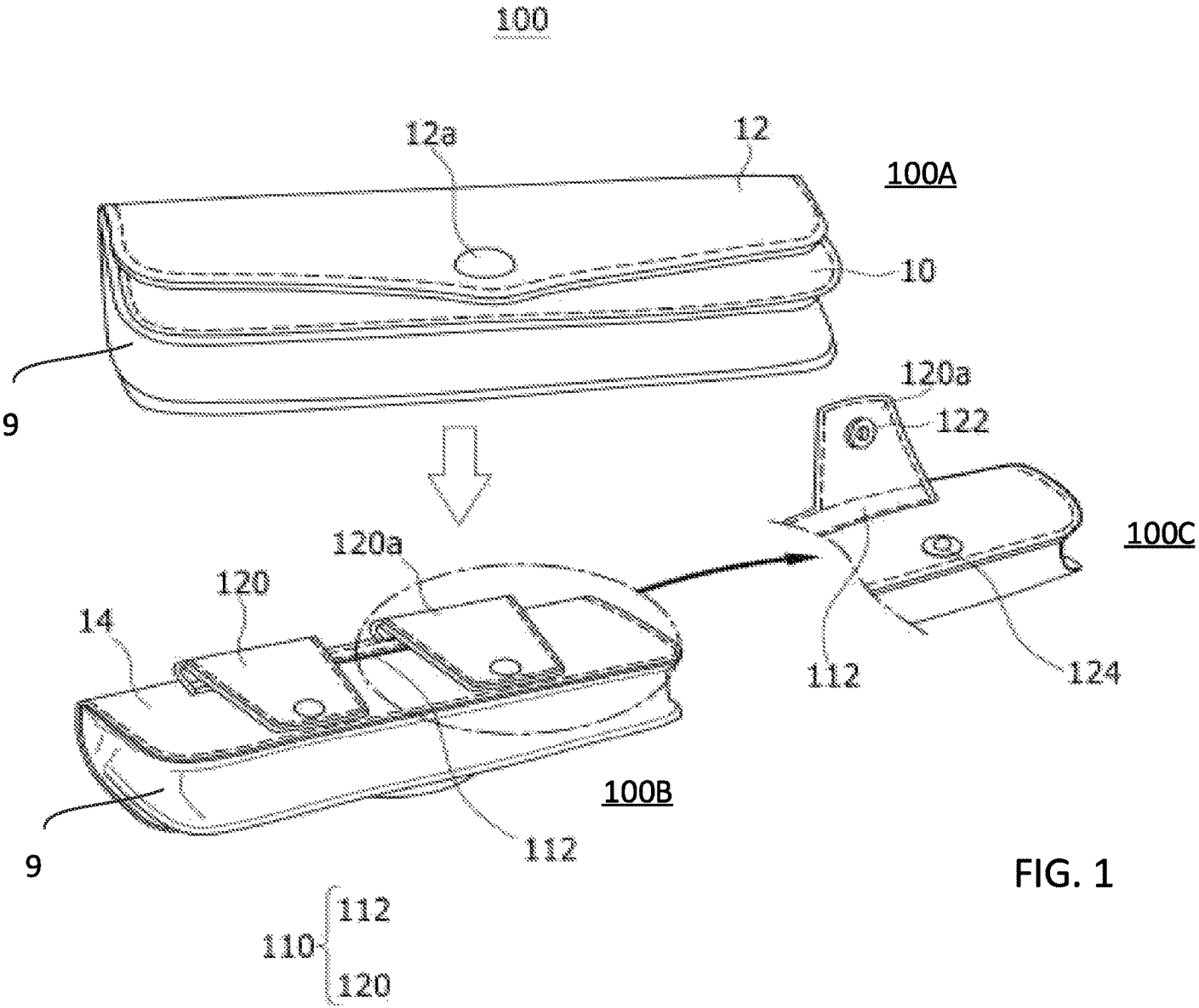
FIG. 1 illustrates multiple views of a carrying case, according to an embodiment of the disclosure.

FIG. 1 illustrates multiple views 100A, 100B and 100C of a carrying case 100 (e.g., an eyeglasses case 100), according to an embodiment. FIG. 1 illustrates view 100A of a first side (or opening side or front side) of an eyeglasses case 100, according to an embodiment of the disclosure. The eyeglasses case 100 may include a main body housing 9 surrounding a cavity that forms a storage space therein, and may have an opening on the first side to provide access to the storage space. The storage space may be designed to accommodate correspondingly-sized articles/objects (e.g., eyeglasses or sunglasses) within the storage space of the main body housing 9.

The main body housing 9 may include a moveable part 12 coupled to the first side of the main body housing 9 (or adjacent to the first side), according to an embodiment. The moveable part 12 may be moveable between a first position that opens the opening (to provide access to the storage space) and a second position that closes the opening (to prevent access to the storage space and prevent an object in the storage space from leaving (e.g., from being ejected from the storage space)).

The main body housing 9 and the moveable part 12 may be integrally formed. The main body housing 9 may comprise one or more of a fibrous material (e.g., a woven fabric, a knitted fabric), leather, nylon canvas and/or synthetic/artificial leather. The material may be uniform (i.e., the same or similar) for each of the main body housing 9, moveable part 12 and one or more partially-detachable loop portion(s) 120, 120*a*. Partially-detachable means at least one end is detachable while a second end is fixedly attached (e.g., sewn, glued and/or stapled), according to an embodiment.

That is, the moveable part 12 and one or more partially-detachable loop portion(s) 120, 120*a* may be made of the same or a similar looking material as the main body housing 9, according to an embodiment. According to an embodiment, the first fastening means 12*a* may be formed of other materials, such as a metal button, Velcro®, magnet(s), according to an embodiment. Velcro® may mean a fastener for clothes or other items/articles, consisting of two strips of thin plastic sheet, one covered with tiny loops and the other with tiny flexible hooks, which adhere when pressed together and can be separated when pulled apart deliberately. Any material described in this disclosure may be used for any other component, and two or more components may be made of the same material.

In an embodiment, the eyeglasses case 100 may include a first fastening means 12*a* (e.g., female button 12*a*) embedded in a moveable part 12 of a main body housing 9 of the eyeglasses case 100. The moveable part 12 may be a flap. A flap may be a piece of something thin, such as leather, nylon canvas, cloth, paper, or metal, hinged or attached only on one side, that covers an opening or hangs down from something. The moveable part 12 may be installed along a longitudinal direction of the surface 10 of the main body housing 9. According to an embodiment, a zipper may also be provided in the longitudinal direction (or instead of the moveable part) so that the storage space of the main body part 10 can be easily opened and closed from the upper end.

According to an embodiment, the first fastening means 12*a* may engage with an outer (front) surface 10 of the main body housing 9 to hold the closing part 12 in a closed position (a first position). The first fastening means 12*a* may be formed as a part of a button coupling structure that includes a female button 12*a* and male button (see male button 124 as a reference example). For example, the button coupling structure may include a snap female button 12*a* provided on the moveable part 12 and a male button provided on the surface 10. The button coupling structure may be provided to couple/decouple the outer (front) surface 10 of the main body housing 9 to/from the moveable part 12. Although the fastening means 12*a* is shown as a button coupling structure, other fastening means may be used, such as Velcro®, a magnet or the like as would be recognized by a person of ordinary skill in the art.

FIG. 1 also illustrates a view 100B of a second side (or engaging side or back/rear side) of the eyeglasses case 100, according to an embodiment. The second side may be on an opposite side of the main body housing 9 as the first side. On the second side, an engaging part 110 may be provided on an outer (back) surface 14 of the main body housing 9, and the engaging part 110 may include contacting part 112 and one or more partially-detachable loop portion(s) 120, 120*a*. Partially-detachable, in this context, means that one end of the loop portion 120 or 120*a* can be fastened and un-fastened manually without use of a tool (e.g., using only one human hand). The engaging part 110 has one or more partially-detachable loop portion(s) 120, 120*a* fixedly attached to the main body housing 9 to form a support space in which the belt 200 is inserted (e.g., vertically inserted) and supported. The contacting part 112 and the detachable part may be provided integrally.

As shown in the view 100B of the second side of the eyeglasses case 100, additional button coupling structures for each of the one or more partially-detachable loop portion (s) 120, 120*a* may be provided (View 100B shows two partially-detachable loop portions 120, 120*a* but more (e.g., three or more) or less may be provided).

The engaging part 110 has a contacting part 112 in contact with the belt 200. Each of the one or more partially-detachable loop portions may have a trapezoidally elongated shape. That is, a partially-detachable loop portion may be flexible, and have an elongated shape (e.g., a trapezoidally-elongated shape) that grows narrower from the first end to the second end to prevent shaking of any contents within the storage space, the second end being attachable to the outer surface of the main body housing to close the loop. A plurality of partially-detachable loop portions 120, 120*a* may be provided to form a plurality of support spaces.

The width of the contacting part 112 where it fixedly contacts the carrying case may be formed wider than the end of the one or more partially-detachable loop portions that provides the second fastening means. With this configuration, it is possible to support the detachable coupling of the one or more partially detachable loop portions 120, 120*a* in a more stable state (e.g., compared to the carrying case of FIGS. 17A and 17B). By forming the one or more partially detachable loop portions 120, 120*a* to have a narrower lower width than the upper width, interference with the belt 200 can be minimized during attachment and detachment, and the detachable operation can be performed more easily and safely.

The contacting part 112 maintains a wide fixed state from the upper side of the main body housing 9, and the one or more partially detachable loop portions 120, 120*a* is formed narrower than the contacting part 112 and is provided along the downward direction of the contacting part 112 to secure the belt 200. By keeping the wrap and fixed to the main body housing 9, it is possible to easily perform the detachable operation of the detachable end of one or more partially detachable loop portions 120, 120*a*. Even if the one or more partially detachable loop portions 120, 120*a* maintain a partially incompletely fixed state to the main body housing 9, the contacting part 112 maintains a widely fixed state to prevent twisting of the one or more partially detachable loop portions 120, 120*a* (e.g., straps 120, 120*a*), and the shape in which the one or more partially detachable loop portions 120, 120*a* is coupled to the contacting part 112 It can be maintained relatively well. Accordingly, the one or more partially detachable loop portions 120, 120*a* can continue to maintain the shape coupled to the contacting part 112 and maintain the shape surrounding the belt 200. And it is possible to continuously maintain a stable shape of the one or more partially detachable loop portions 120, 120*a*, and it is possible to prevent the main body housing 9 from being easily separated from the belt 200. On the other hand, when the one or more partially detachable loop portions 120, 120*a* is formed in a general strap shape (as in FIG. 17), the shape of the one or more partially detachable loop portions 120, 120*a* is easily deformed or is easily rolled even by a small external force may occur. In addition, the one or more partially detachable loop portions 120, 120*a* and the belt loop may interfere with each other, so that the state in which the detachable art is supported by the belt 200 is released.

The number of the engaging part 110 may be at least one or more, and when a plurality of engaging parts 110 are provided, the contacting part 112 and the detachable part are constant along the longitudinal direction of the main body housing 9. It may be provided to be spaced apart at intervals. For example, the plurality of contacting portions 112 and the partially detachable loop portions 120, 120*a* may be provided to be spaced apart from each other at appropriate intervals not to interfere with the belt loops provided on the lower part.

View 100C shows an exploded view of a portion (delineated by a dashed circle and indicated by a downward arrow) of the view 100B but with the partially detachable loop portions 120, 120*a* being in an open (partially-detached) position. As shown in view 100C, one or more second fastening means 122, 124 may be formed as a part of one or more second button coupling structures. Each of the one or more second button coupling structures may include a female button 122 and a male button 124. For example, the button coupling structure 122, 124 may include a snap (female) button 122 provided on a first (detachable) end of a partially-detachable loop portion 120*a*, and a male button 124 provided on an outer surface 14 of the main body housing 9. According to an alternative embodiment, the male button may be provided on the first (detachable) end of a partially-detachable loop portion 120*a*, and the female button provided on the outer surface 14. Each of the one or more partially-detachable loop portion(s) 120, 120*a* may include a respective button coupling structure 122, 124, which may be provided to couple/decouple the outer (back) surface 14 of the main body housing 9 to/from the first end of the partially-detachable loop portion 120, 120*a*. Although the second fastening means 122, 124 is shown as a snap button coupling structure, other second fastening means may be used, such as Velcro®, a magnet or the like as would be recognized by a person of ordinary skill in the art.

Each of the one or more partially-detachable loop portion (s) 120, 120*a* may include a respective button coupling structure, which may be provided to couple/decouple the outer (front) surface 10 of the main body housing 9 to/from the moveable part 12. Although the fastening means (e.g., first fastening means 12*a* or second fastening means) is shown as a button coupling structure, other fastening means may be used, such as Velcro®, a magnet or the like as would be recognized by a person of ordinary skill in the art.

The engaging part 110 is provided on the rear surface 14 of the main body housing 9 to partially fix the main body housing 9 to the belt 200. The material of the engaging part 110 may be formed of a flexible material such as a fiber material, leather, artificial leather, or a flexible synthetic resin. Through the material characteristics of the engaging part 110, the contacting part 112 and the one or more partially detachable loop portions 120, 120*a* can be freely maintained in folding or unfolding. According to an embodiment, a plurality of belt loops into which the belt 200 is fitted are provided at regular intervals on the waist in trousers or bottoms including a skirt, and the main body housing 9 may be fixed to the belt 200 fitted to the belt loop through the engaging part 110.

The engaging part 110 is coupled to the main body housing 9 in an opening/closing structure with a contacting part 112, at least a part of which is fixedly coupled to the second side 14 at a preset fixing position on the outer rear surface 14 of the main body housing 9, and the other (first) side is openable and closeable to provide/prevent access to the storage space.

Figure 2:
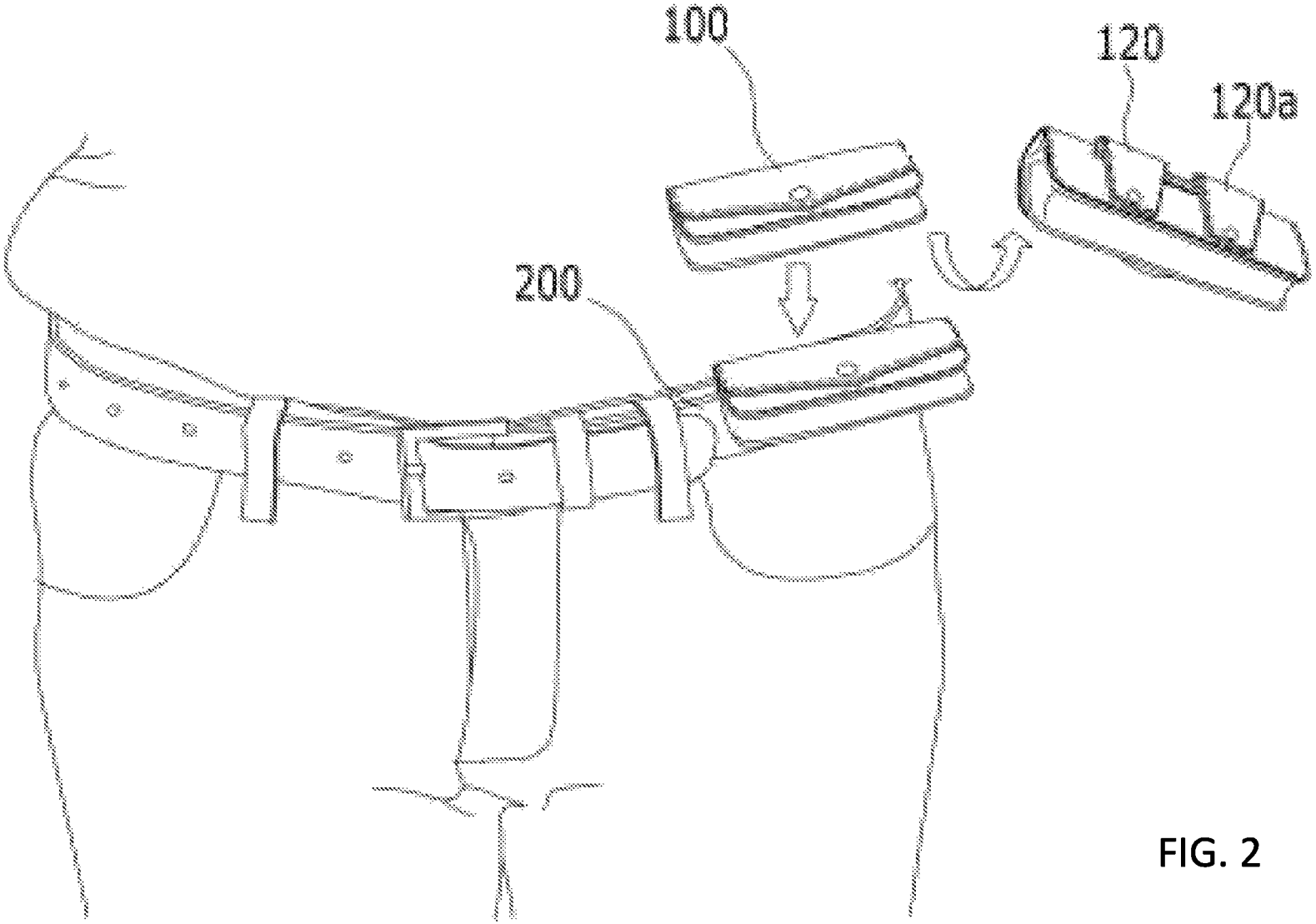
FIG. 2 illustrates a state in which the carrying case is coupled to the belt, according to an embodiment of the disclosure.

FIG. 2 illustrates a state in which the eyeglasses case 100 is coupled to the belt as indicated by the downward arrow, according to an embodiment. As shown in FIG. 2, the eyeglasses case 100 may be wearable by being firmly and easily attached to a belt 200 worn on the wearer's (human) waist (by a motion as indicated by the downward arrow). That is, after the eyeglasses case 100 is moved downward (in the direction of the downward arrow), and the belt 200 and the eyeglasses case 100 are on a same plane, the engaging part 110 may be coupled/de-coupled to/from a user's belt 200 in a state in which the belt is being worn. According to an embodiment, the belt 200 may be partially or fully wrapped around a human waist. As shown by the down arrow in FIG. 2, the eyeglasses case 100 may be coupled to the belt 200 by means of partially detachable loop portions 120 and 120*a* when they are in a fastened position. The eyeglasses case may be removed by the opposite actions, including unfastening the partially detachable loop portions 120, 120*a* and moving the eyeglasses case 100 away from the belt 200 (e.g., this motion is indicated by the semi-circle arrow of FIG. 2).

Figure 3:
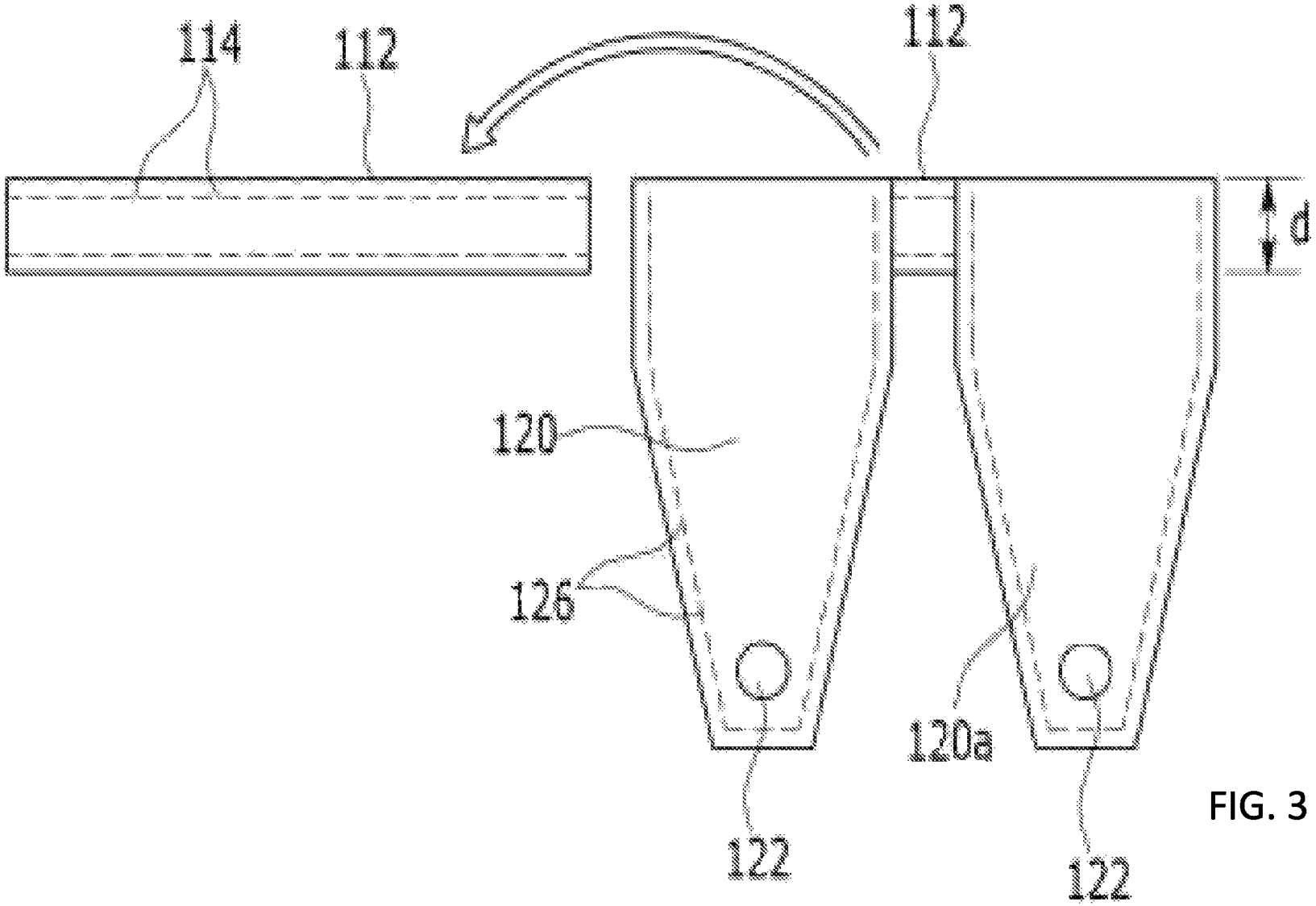
FIG. 3 illustrates an engaging part, according to an embodiment.

FIG. 3 illustrates an engaging part 110, according to an embodiment. The engaging part 110 may include a contacting part 112 and a sewing process (or stitched pattern) 114. The contacting part 112 may be formed in a long strip shape along the longitudinal direction of the main body housing 9. The contacting part 112 may have at least an edge portion coupled to the main body housing 9 by a sewing process (or stitched pattern) 114. Meanwhile, the contacting part 112 may be attached to the surface in contact with the main body housing 9 using an adhesive, such as glue. At least an upper portion of the contacting part 112 may be integrally coupled to the rear surface 14 of the main body housing 9 through a sewing process (or stitched pattern) 114 and/or an adhesive, such as glue. According to an embodiment, the contacting part 112 may maintain a stronger coupling with the main body housing 9 by using an adhesive and/or a sewing process (or stitched pattern) 114. The contacting part 112 may be formed in a long strap shape along the longitudinal direction of the main body housing 9. The contacting part 112 may have a rectangular shape. The height direction length d of the contacting part 112 may be at least equal to or longer than the height direction length in the upper part of the detachable part. A stitched pattern 126 may also be provided as shown by dotted lines in FIG. 3.

Figure 4:
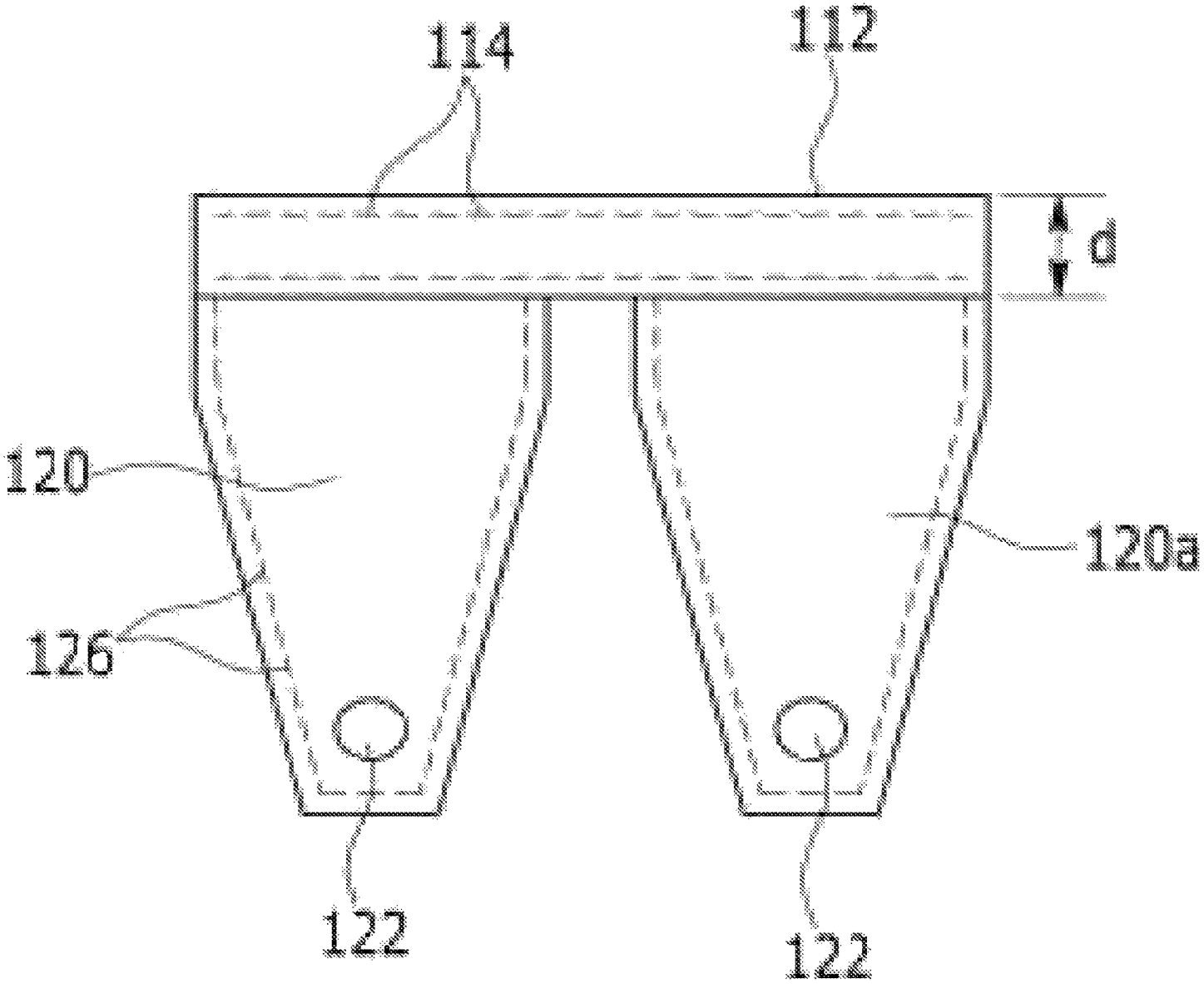
FIG. 4 illustrates a state in which the contacting part 112 of FIG. 3 is unfolded, according to an embodiment of the disclosure.

FIG. 4 is a view showing a state in which the contacting part 112 of FIG. 3 is unfolded. The overall length of the contacting part 112 based on the longitudinal direction of the main body housing 9 is formed to be longer than the entire length of the one or more partially-detachable loop portions, so that the contacting part 112 can be widened. That is, the contacting part 112 may be provided longer than the one or more partially-detachable loop portions to be fixedly coupled to the main body housing 9. According to an embodiment, a first end of the partially-detachable loop portion is connected to the contacting part 112 and the other end of the partially-detachable loop portion is connected in a coupling structure such that the loop portion is bent downward such that a gap, or loop is formed in which the one or more partially-detachable loop portions is spaced apart from the main body housing 9 due to the bending of the contacting part 112 and the one or more partially-detachable loop portions. It is possible to easily form a support space into which the belt 200 is inserted. Here, the upper end of the contacting part or support part 112 refers to an end positioned above the contacting part 112 based on the state in which it is coupled to the main body housing 9. As shown in FIG. 4, in a state in which the contacting part 112 and the one or more partially-detachable loop portions are connected and unfolded, the lower side of the contacting part 112 may be directly connected to one side of the one or more partially-detachable loop portions. As shown in FIGS. 1 and 3, according to an embodiment, the surface of the contacting part 112 shown in FIG. 4 becomes a surface in contact with the main body housing 9 in a folded state when it is coupled to the main body housing 9. Through the coupling structure of the contacting part 112 and the one or more partially-detachable loop portions, the contacting part 112 can stably maintain a fixedly coupled state to the main body housing 9, and it is possible to more firmly and flexibly support the attaching and detaching operation of the one or more partially-detachable loop portions. In addition, as one end of the one or more partially-detachable loop portions is connected to the upper end of the contacting part 112 and the other end is connected in a coupling structure that is bent downward, the bent part of the contacting part 112 and the one or more partially-detachable loop portions functions to be supported by the belt 200. According to an embodiment, the one or more partially-detachable loop portions from the main body housing 9 is formed longer and wider at the fixed portion (e.g., one or more of stapled, sewn, and/or glued), so that the support space into which the belt 200 is inserted can be secured more widely.

The one or more partially-detachable loop portions may be formed in the shape of a curved strap. That is, the one or more partially-detachable loop portions may be provided with a slightly-curved, long downward direction substantially perpendicular to the longitudinal direction of the main body housing 9 and may be provided with a coupling structure in which one end is fixed to the contacting part 112 and the other end is freely detachable/attachable. By forming the one or more partially-detachable loop portions in this shape, interference with the one or more partially-detachable loop portions and the belt loop is minimized, and the state in which the one or more partially-detachable loop portions is supported by the belt 200 can be firmly and stably maintained. The one or more partially-detachable loop portions may further include a reinforcing part or structure 126 (e.g., a sewn stitched pattern 126) provided on the edge surface to prevent shape deformation of the one or more partially-detachable loop portions. According to an embodiment, the reinforcement part 126 may include a sewing reinforcement structure that is sewn in a zigzag-shaped stitch. According to an embodiment, sewing reinforcement structure is not only sewn in a straight line using a zig zag sawing machine, but is sewn in parallel in a straight line and a zigzag direction to firmly reinforce the structure of the one or more partially-detachable loop portions. By implementing a stitching sewing process on the edge of the one or more partially-detachable loop portions, the one or more partially-detachable loop portions is maintained more firmly, and the shape of the strap of the one or more partially-detachable loop portions can be prevented from being twisted. If necessary, the reinforcing part 126 may include a wire reinforcing structure in which a reinforcing wire is installed along an edge direction of the one or more partially-detachable loop portions.

The one or more partially-detachable loop portions may be provided to be folded or unfolded relatively freely, unlike the contacting part 112. One end of the partially-detachable loop portion(s) may be connected to the contacting part 112, and the other end may be removably coupled to the main body housing 9. When the contacting part 112 is fixed to the rear surface 14 of the main body housing 9 and the belt 200 is positioned in the support space in a state where the removable part and the supporting space are formed, the removable part wraps around the outer surface of the belt 200. The one or more partially-detachable loop portions is coupled to the main body housing 9 by a detachable member (e.g., fastening means, fastener) provided at the end, so that the main body housing 9 is worn on the belt 200 side to safely support the fixed state.

The one or more partially-detachable loop portions is connected to one side along the longitudinal direction of the contacting part 112 the first removable part 120 having a preset length and coupled to the first removable position, and the other side along the longitudinal direction of the contacting part 112. It may include a second partially-detachable loop portion 120*a* connected to, having a preset length, and coupled to a second detachable position corresponding to the first detachable position of the first partially-detachable loop portion 120. The fastening means may be provided at one or more ends of the first partially-detachable loop portion 120 and the second partially-detachable loop portion 120*a*, respectively. In addition, one or more second detachable members (e.g., fastener, button) may be provided at a position of the main body housing 9 corresponding to the first detachable member. For example, the detachable members (fastening means) may include a button coupling structure including a female button 122 and a male button 124. In this case, the button coupling structure may include a detachable member provided at an end of the detachable portion and a snap button including a male button and a female button installed to correspond to the main body housing 9. By forming the detachable member with a snap button, the coupling relationship between the one or more partially-detachable loop portions and the main body housing 9 can be easily detached. On the other hand, the detachable member may include Velcro®. In addition, various coupling structures such as a magnetic coupling structure and a buckle coupling structure may be applied to the detachable member. For example, the removable member may be provided with Velcro®. Velcro® is provided with a first coupling portion formed to be slippery on one side and a second coupling portion formed softly on the other side, so that the first coupling portion and the second coupling portion can be used by attaching or separating the first coupling portion from each other.

A process of wearing the glasses case 100 on the belt 200 according to an embodiment of the present invention will be described with reference to FIGS. 1 to 4. First, it is assumed that the glasses are accommodated in the storage space of the main body housing 9, and the contacting part 112 is stably fixedly coupled to the rear surface 14 of the main body housing 9, and the one or more partially-detachable loop portions from one side of the contacting part 112 is coupled to the main body housing 9, and the belt. In a state in which a support space is formed so that the belt 200 is insertable, the coupling state between the one or more partially-detachable loop portions and the main body housing 9 is released from the rear surface 14 of the main body housing 9. After the belt 200 is positioned in the support space, the one or more partially-detachable loop portions is maintained in a coupled state with the main body housing 9. As described above, by positioning the belt 200 in the support space of the one or more partially-detachable loop portions and coupling the detachable member of the one or more partially-detachable loop portions to the main body housing 9, the main body housing 9 can be safely fixed to the belt 200.

Figure 5:
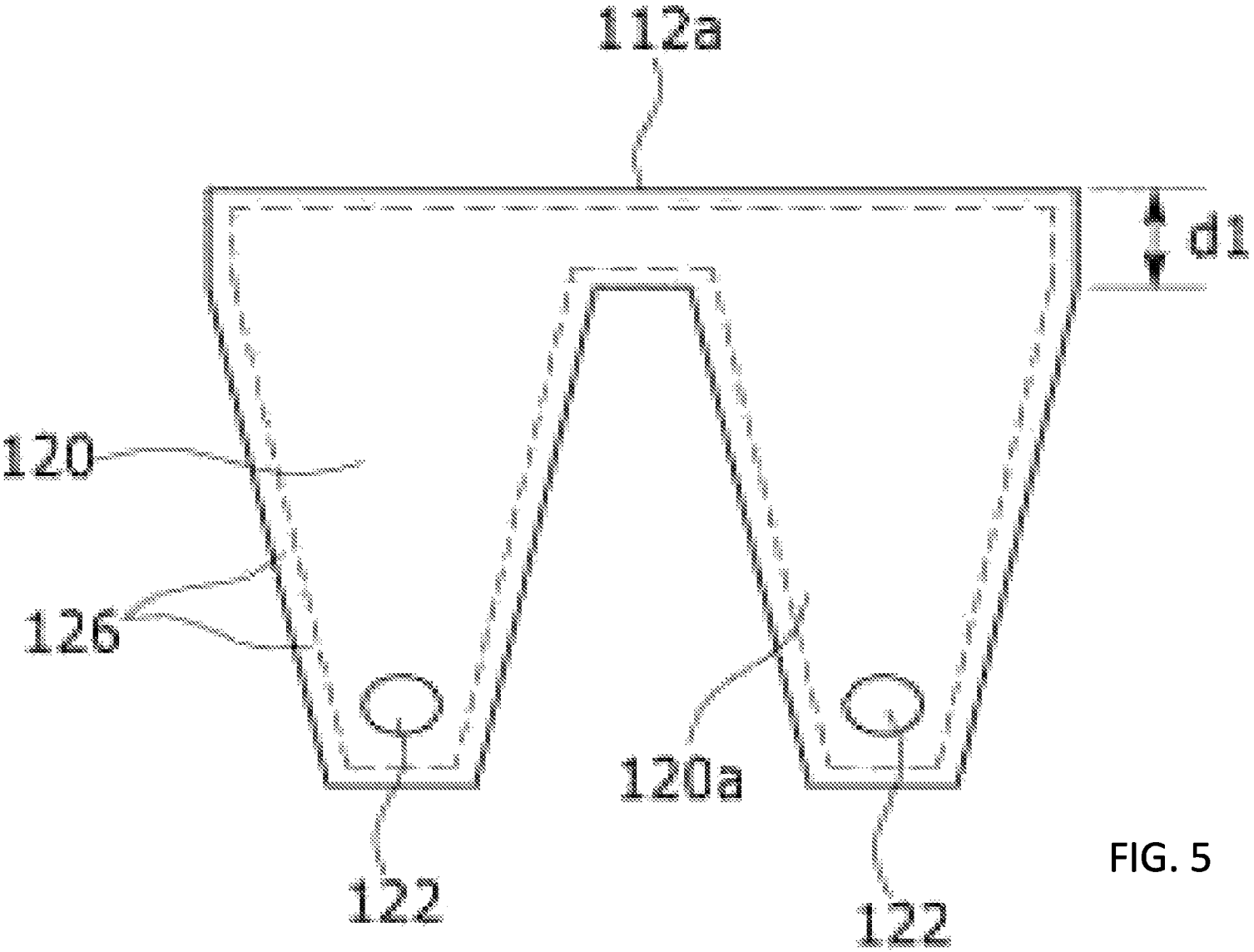
FIG. 5 illustrates a modified example of the contacting part 112, according to an embodiment of the disclosure.

FIG. 5 illustrates a modified example of the contacting part 112, according to an embodiment of the disclosure. Referring to FIG. 5, at least the upper and side portions of the contacting part 112*a* may be coupled to the main body housing 9 by a sewing process. The contacting part 112*a* may be formed in a long strap shape along the longitudinal direction of the main body housing 9. The contacting part 112*a* may have a rectangular shape. The height direction length d1 of the contacting part 112*a* may be at least equal to the height direction length d of FIG. 4. Referring to FIG. 5, as one side of the partially-detachable loop portion is connected to the lower end of the contacting part 112*a* and the other side is connected in a coupling structure that is connected downward, the contacting part 112*a* and the partially-detachable loop portion are curved from the main body housing 9 to the fastening portion. A spaced interval can be formed to easily form a support space into which the belt 200 is inserted. Here, the lower end of the contacting part 112*a* refers to a part where the fixing part and the one or more partially-detachable loop portions are connected. As shown in FIG. 5, in a state in which the contacting part 112*a* and the one or more partially-detachable loop portions are connected and unfolded, the lower side of the contacting part 112*a* may be directly connected to one side of the one or more partially-detachable loop portions. As shown in FIG. 5, the surface of the contacting part 112*a* becomes the surface exposed to the outside when it is coupled to the main body housing 9. Through the coupling structure of the contacting part 112*a* and the one or more partially-detachable loop portions, the contacting part 112*a* can be fixedly coupled to the main body housing more quickly, and by freely maintaining the shared connection part of the contacting part 112*a* and the one or more partially-detachable loop portions. For the one or more partially-detachable loop portions, a detachment operation can be supported more flexibly.

On the other hand, the contacting part 112, 112*a* may be formed in a structure that is coupled from the inside and the outside of the main body housing 9 For example, the contacting part 112, 112*a* includes an inner fixing member coupled to a preset first fixing position inside the main body housing 9, and a second fixing member corresponding to the first fixing position of the inner fixing member from the outside of the main body housing 9. It may include an outer fixing member coupled to the position. Here, the fastening means 122 may be attached to the main body housing 9 by magnetic coupling. And the contacting part 112, 112*a* may be fixed to the main body housing 9 by stitching. In addition, the fastening means and/or contacting part 112, 112*a* may be fixed to the main body housing 9 by performing magnetic coupling and stitching coupling in parallel. For example, the rim portion of the contacting part 112, 112*a* may be primarily fixed to the main body housing 9 by stitching, and the inner portion of the rim portion of the contacting part 112, 112*a* may be secondarily fixed to the main body housing 9 by magnetic coupling.

As described above, in an embodiment, a button coupling structure is provided on one side of the fixing engaging part 110 to couple the plurality of one or more partially-detachable loop portions to the rear surface 14 of the main body housing 9. That is, the engaging part 110 includes one or more fastening means (e.g., fasteners) provided on the rear surface 14 of the main body housing 9 and one or more partially-detachable loop portions provided on both sides of the contacting part and detachably coupled to the main body housing 9. Here, at least one side of the two one or more partially-detachable loop portions are connected to each other through a fixing part and may be coupled to the main body housing 9. Alternatively, the two one or more partially-detachable loop portions may be independently separated from each other and respectively coupled to the main body housing 9 (e.g., as shown in FIG. 6).

Figure 6:
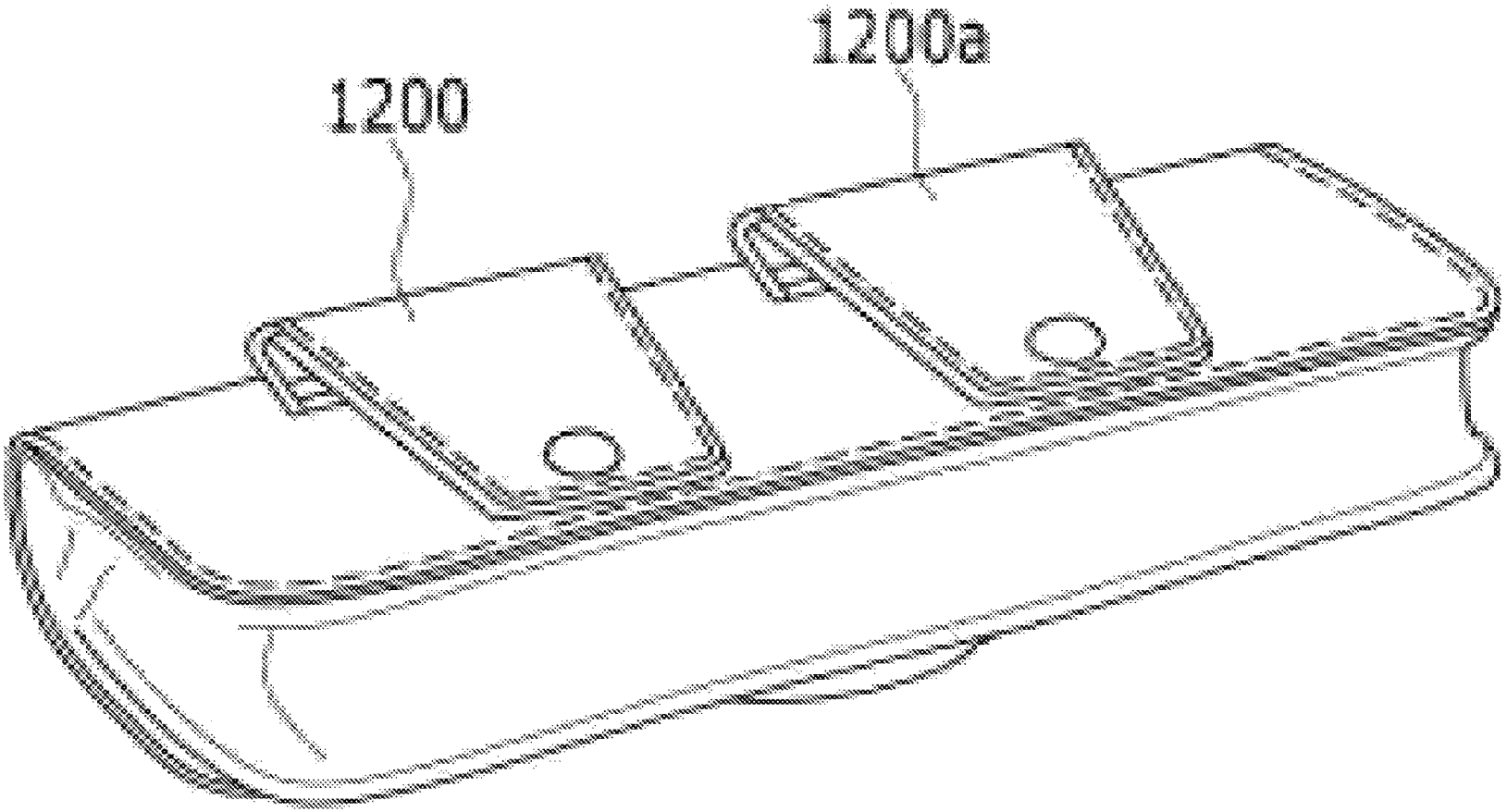
FIG. 6 illustrates a view showing a carrying case, according to an embodiment of the disclosure.
Figure 7:
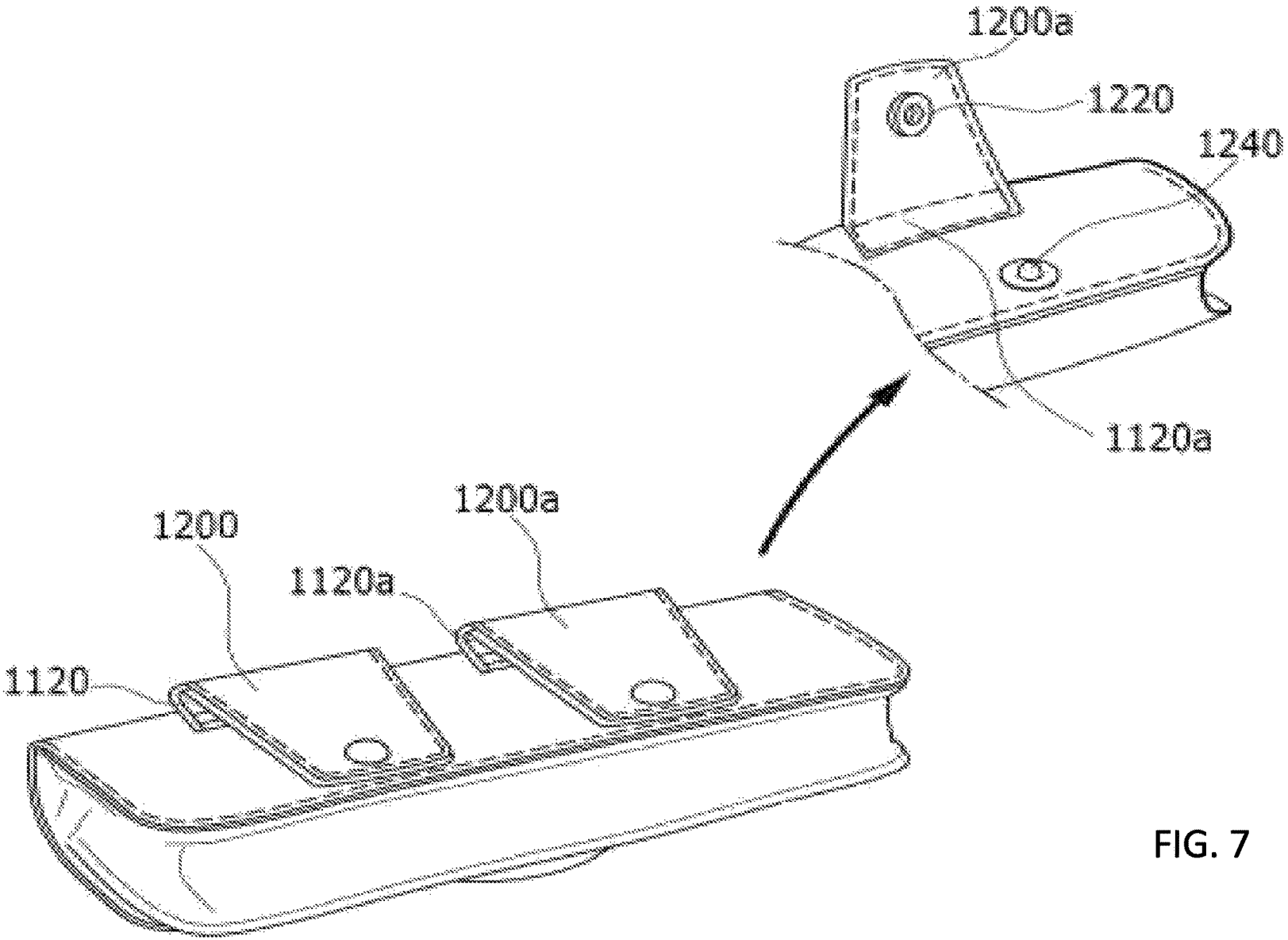
FIG. 7 illustrates a view of a coupling relationship of the carrying case, according to an embodiment of the disclosure.

FIG. 6 illustrates a view showing an eyeglasses case 100, according to an embodiment of the disclosure, and FIG. 7 illustrates a view of a coupling relationship between the fixing and engaging portion of the eyeglasses case and the main body, according to an embodiment of the disclosure.

While explaining the carrying case according to an embodiment, a detailed description of the contents overlapping with the carrying case according to the embodiment will be omitted. Referring to FIGS. 6 and 7, the two contacting (fixed) parts and the two partially-detachable loop portions may be independently separated from each other and coupled to the main body housing 9, respectively. Here, the two fixed, contacting parts and the two partially-detachable loop portions may be integrally formed with the contacting/fixed part and the one or more partially-detachable loop portions corresponding to each other, respectively. In this case, the contacting part is a first contacting part 1120 coupled to a preset first fixing position from the outside of the main body housing 9, and the first contacting part 1120 is fixed outside of the main body housing 9. According to an embodiment, the carrying case may include a second fixed contacting part 1120*a* coupled to the second fixing position. The one or more partially-detachable loop portions is connected to the first contacting part 1120, has a preset length and is connected to a fastening means, and the second contacting part 1120*a* coupled to the first removable position, and has a preset length. A second detachable loop portion 1200*a* may be coupled to a second detachable position corresponding to the first detachable position of the first detachable loop portion 1200.

The first contacting part 1120 and the second contacting part 1120*a* may be provided to be wider than the width of the first partially-detachable loop portion 1200 and the second partially-detachable loop portion 1200*a*, respectively. In addition, the first contacting part 1120 and the second contacting part 1120*a* may be integrally provided with the main body housing. The one or more partially-detachable loop portions may further include a reinforcing part 1260 (FIG. 8) provided on the edge surface to prevent shape deformation of the one or more partially-detachable loop portions. A fastening means (e.g., a fastener, or detachable member) may be provided at the ends of the first partially-detachable loop portion 1200 and the second partially-detachable loop portion 1200*a*, respectively. The fastening means/detachable member may include a button coupling structure including a female button 1220 and a male button 1240. According to an embodiment, at least the upper and side portions of the contacting part of a rim part of the loop portion(s) may be coupled to the main body housing 9 by a sewing process/stitched pattern 1140.

Figure 8:
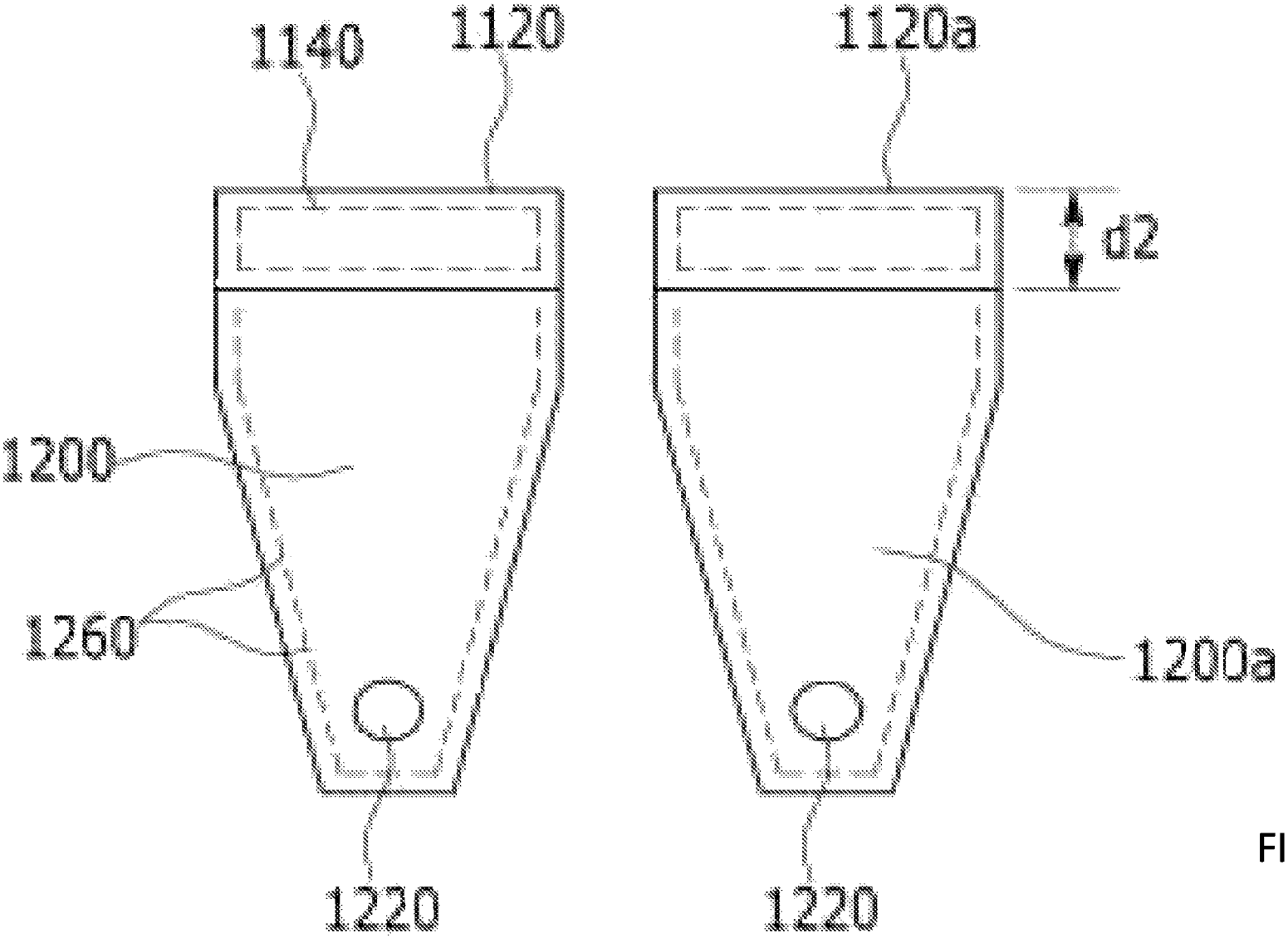
FIG. 8 illustrates a loop portion, according to an embodiment of the disclosure.
Figure 9:
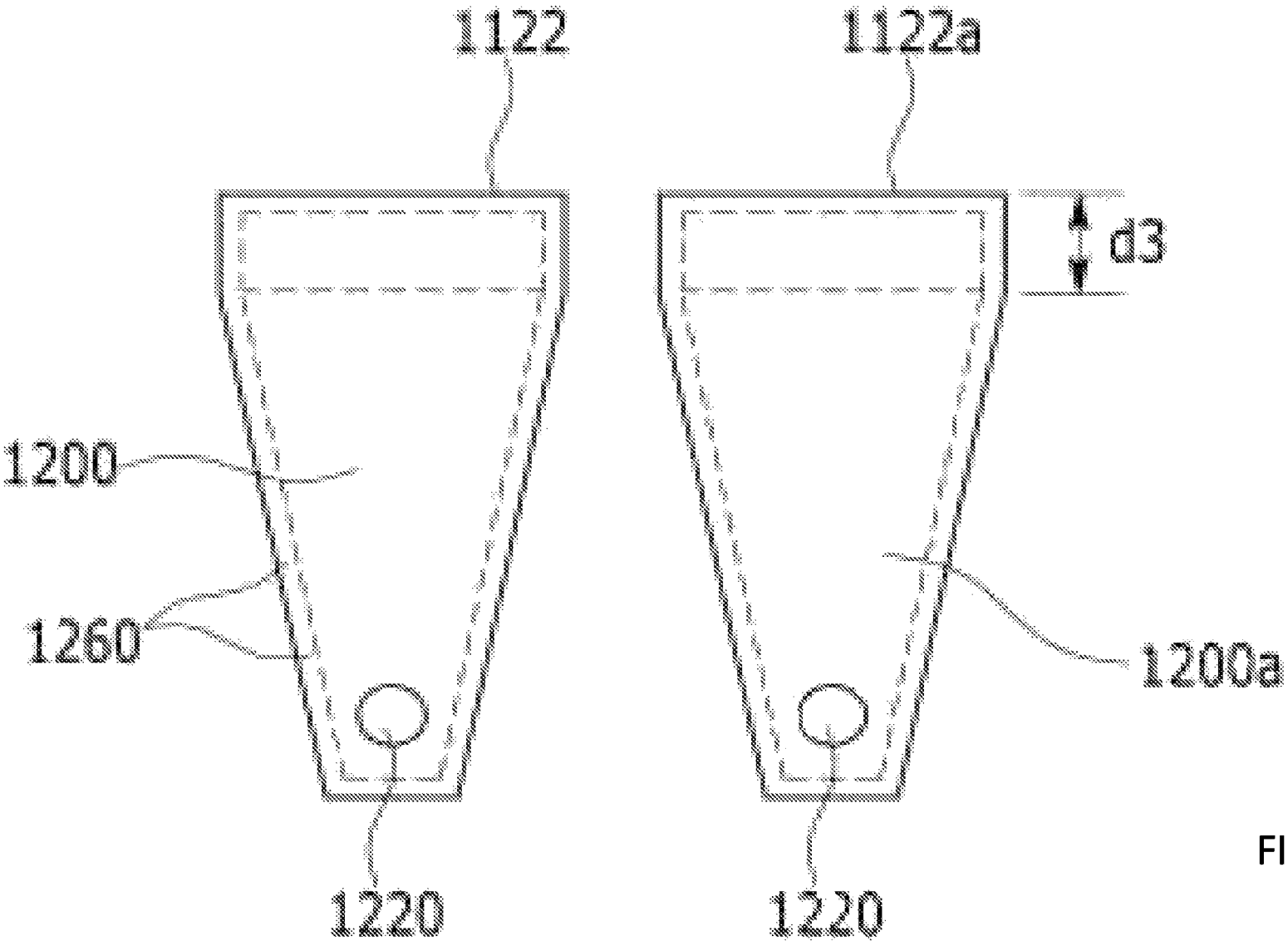
FIG. 9 illustrates a modified example of loop portion, according to an embodiment of the disclosure.

FIG. 8 is a view showing a loop portion according to an embodiment, and FIG. 9 is a view showing a modified example of loop portion. Referring to FIGS. 6-9, the loop portions and contacting parts of the glasses case may be different, according to an embodiment. Referring to FIGS. 8 and 9, a part of an end of the loop portion may be formed in a long strap shape along the longitudinal direction of the main body housing 9. The end may have a rectangular shape. The height direction length d2 of the contacting parts 1120 and 1120*a* in FIG. 8 may be at least equal to the height direction length d3 of the contacting parts 1122 and 1122*a* in FIG. 9. Please note that loop portion and engaging portion/part may be used interchangeably.

Even when the width and height of the glasses case are narrow or curved, when the glasses case is used vertically, the two one or more partially-detachable loop portions can be utilized in an independent form. In this case, the fixing part includes a first fixing part coupled to a first fixing position of an upper side along the longitudinal direction from the outside of the main body housing 9, and a second fixing part on the other side of the upper part from the outside of the main body housing 9 in the longitudinal direction. It may include a second fixing portion coupled to the fixing position. The one or more partially-detachable loop portions are connected to the first fixing part, have a preset length and a first removable part coupled to the first detachable position, and a second one or more partially-detachable loop portions connected to the second fixing part, has a preset length, and is coupled to the second detachable position. It may include one or more partially-detachable loop portions. Here, the first detachable position and the second detachable position may be provided at positions spaced apart from the middle portion or the middle portion upward at a preset interval along the longitudinal direction of the body portion 10. As the first detachable position and the second detachable position are located above the middle part along the longitudinal direction of the main body housing 9, the one or more partially-detachable loop portions minimize interference with the belt loop, and the one or more partially-detachable loop portions is supported by the belt 200 strongly and can be kept stable/stabilized.

The width of the contacting part may be formed wider than the width of an opposite end of the one or more partially-detachable loop portions, so that the contacting part can be fixedly coupled to the main body housing 9. Therefore, in a state in which the fixing part is stably fixedly coupled to the main body housing 9, it is possible to more firmly and flexibly support the detachment operation of the one or more partially-detachable loop portions.

Figure 10:
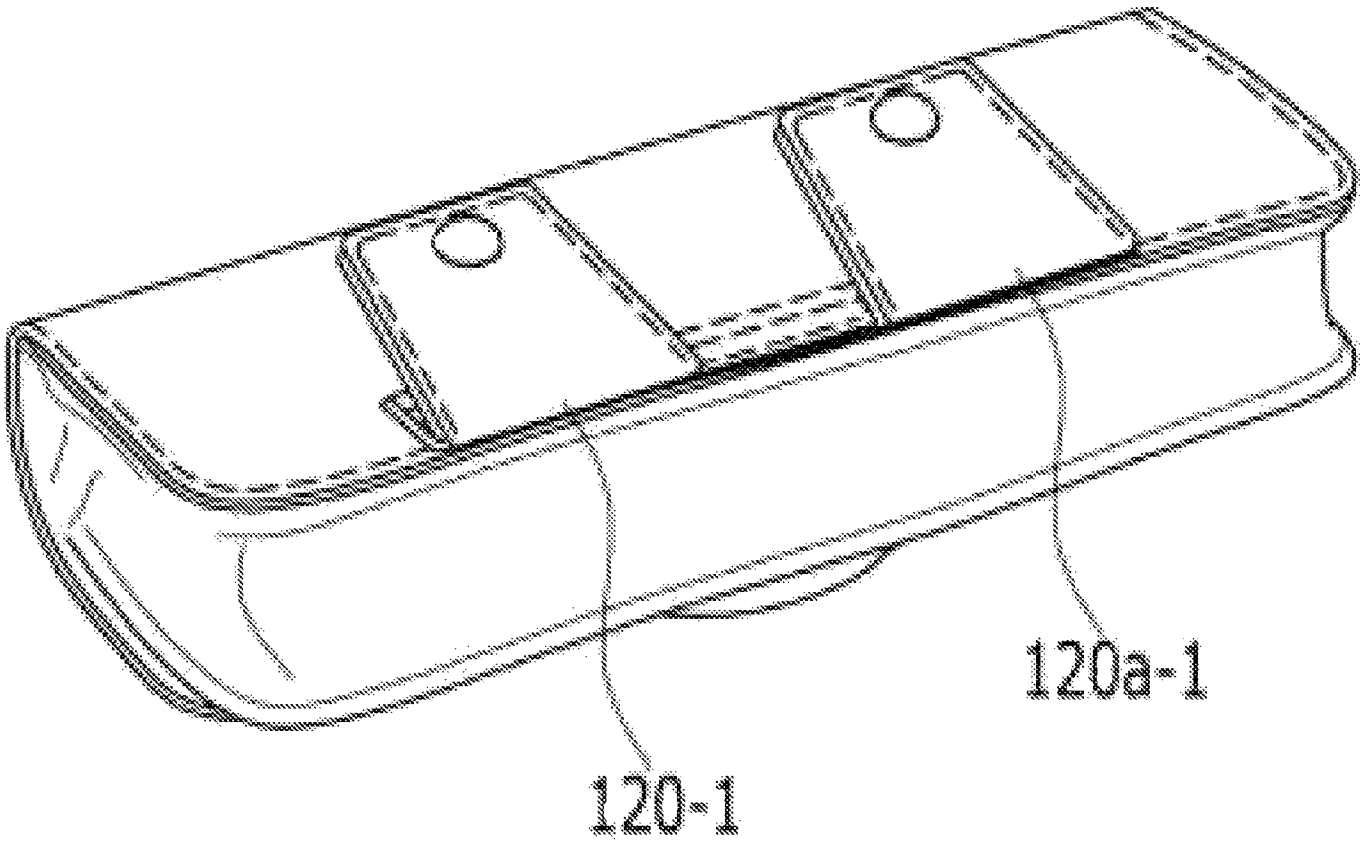
FIGS. 10 and 11 illustrate modified positions and/or orientations of the loop portions, according to embodiments of the disclosure.
Figure 11:
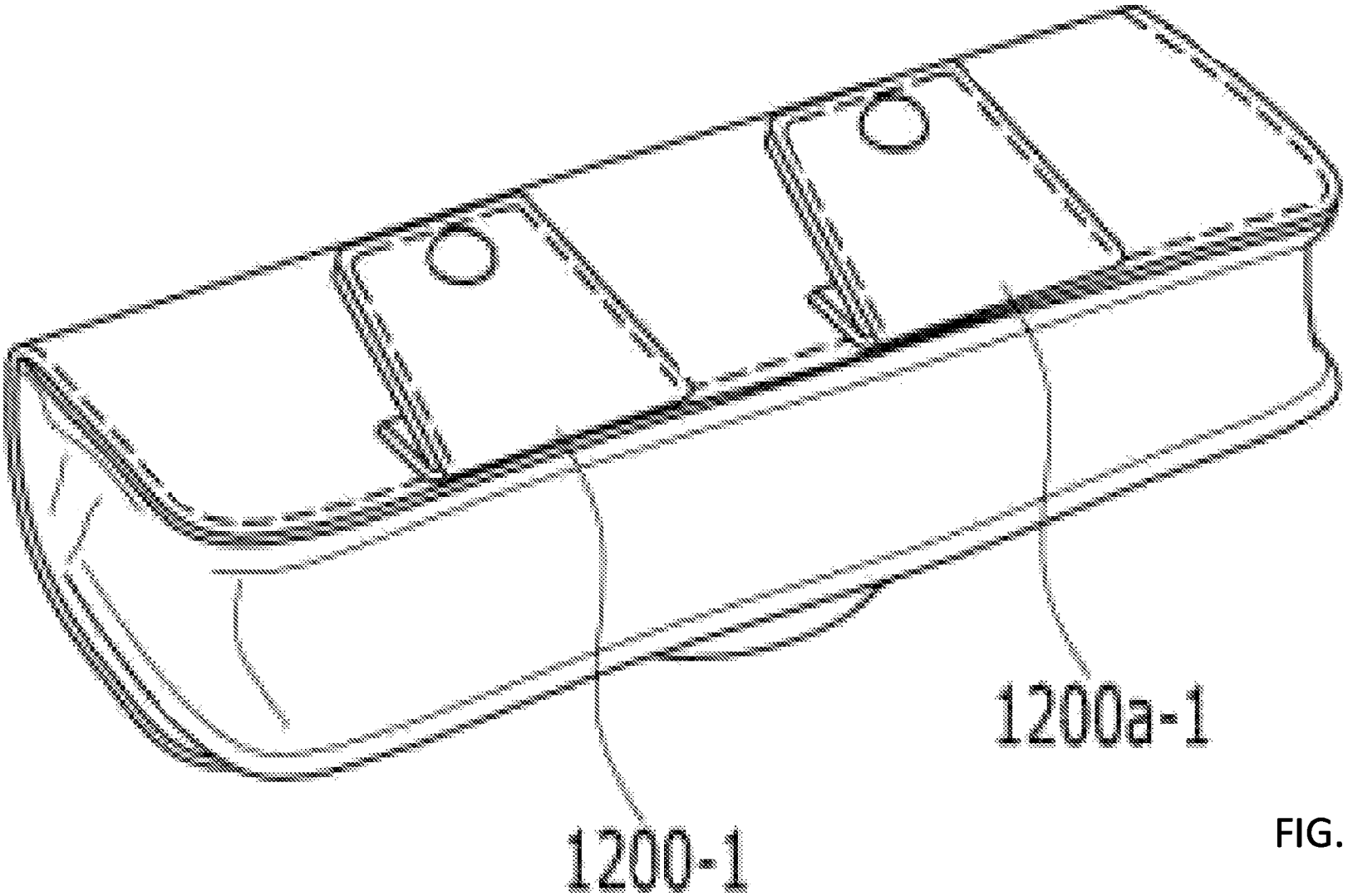

FIG. 10 illustrates a view showing a modified example of the loop portion, according to an embodiment of the disclosure;

FIGS. 10 and 11 illustrate modified positions and/or orientations of the loop portions. Overlapping elements are not repeated and may correspond to previously described elements having a same or similar name.

Referring to FIGS. 10 and 11, in the glasses case according to an embodiment, the one or more partially-detachable loop portions 120-1 and **120*a*-1 are shown in a state in which they are coupled to the main body in a different orientation resulting in a different attachment method than previous described. That is the opening of the flap may be in the same direction as the opening of a loop portion, or in an opposite direction as the opening of the loop portion. As described above, by forming the width of the upper part narrower than the width of the lower part, the interference with the belt 200 can be minimized during attachment and detachment. The contacting part maintains a wide fixed state at the lower side of the main body housing 9**, and the end of the one or more partially-detachable loop portions having the fastening means is formed narrower than the fixed contacting part, and it is possible to easily perform the detachable operation of the detachable portion using one hand.

Figure 12:
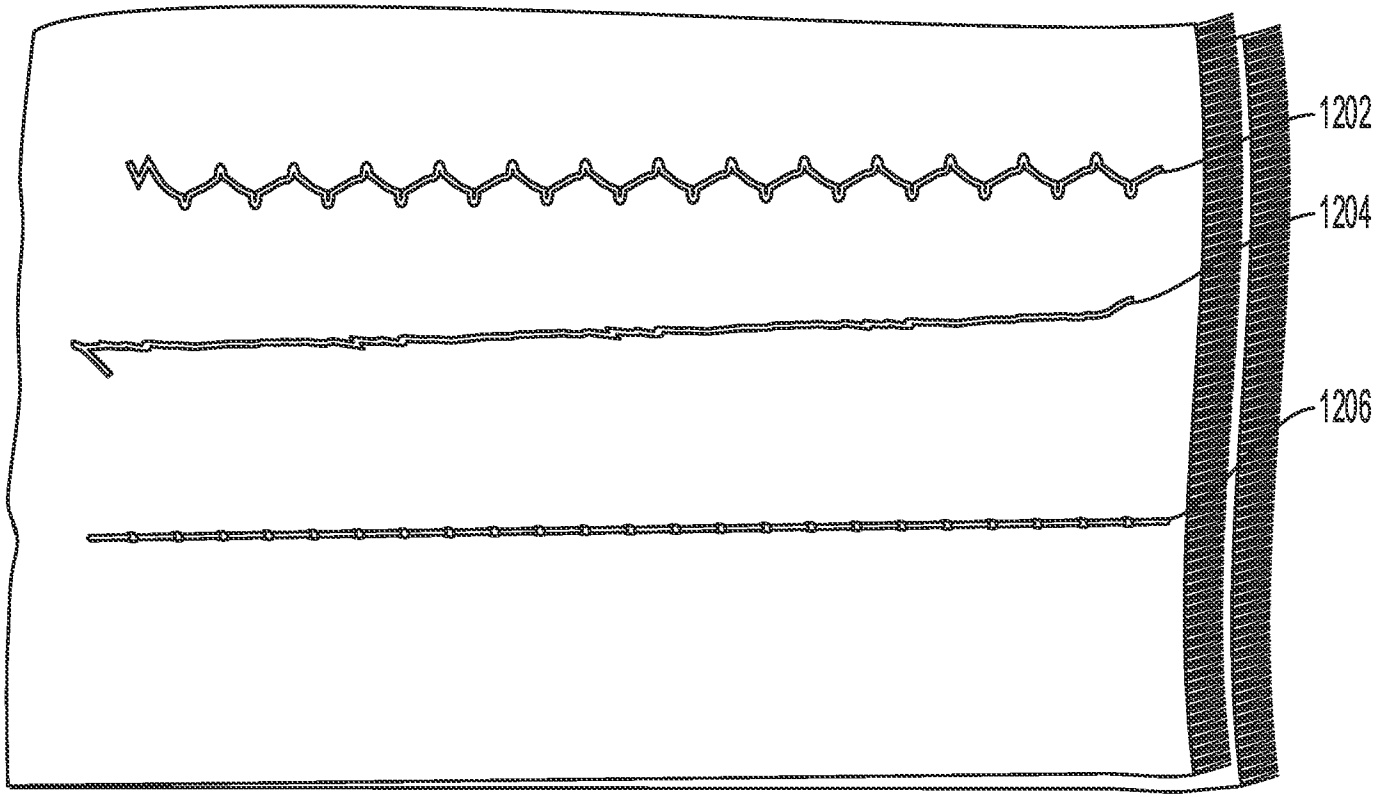
FIG. 12 illustrates various stitching patterns, according to various embodiments of the disclosure.

FIG. 12 illustrates various stitching patterns, according to various embodiments of the disclosure. For example, a zigzag stitch stitching pattern 1202, a single stitch stitching pattern 1204 or a double stitch stitching pattern 1206 may be used for the stitched portion(s) described above (e.g., stitched portion 126).

Explanation of Vertical-entry and Horizontal-entry as it relates to the size/length of the size of the opening of the storage space. The size of the opening of the storage space may correspond to the longest distance of the opening of the storage space. Vertical-entry, according to an embodiment, corresponds to a feature where the opening to the storage space of the carrying case is configured to correspond to a length of the width of the article (e.g., smartphone, eyeglasses). According to an embodiment, the width of the article is the distance between the two longest edges of the article (e.g., smartphone, eyeglasses), or, if no defined straight edges (e.g., eyeglasses), the width is the shorter of a first distance covered by the article (e.g., eyeglasses) in a first direction, and a second distance covered by the article in a second direction perpendicular to the first direction. The first (shorter) direction may be referred to as a width, and the second (longer) direction may be referred to as a length. The article (e.g., smartphone) may have a rectangular shape, a substantially-rectangular shape, an eyeglasses shape, or another shape as described herein). A substantially-rectangular shape may include a rectangular shape with curved corners. The vertical-entry state of the article (e.g., smartphone, eyeglasses) is such that, upon entry into the opening of the storage space, the article (e.g., smartphone, eyeglasses) is in a vertical-entry position/state such that the width (shorter distance between edges/sides) of the article (e.g., smartphone) corresponds to the greatest length of the opening. That is, in the vertical-entry state, the opening of the storage space fits the width of the article (e.g., smartphone, eyeglasses).

In contrast, the horizontal-entry state is the opposite of the vertical entry state, according to an embodiment. In the horizontal-entry state, the width of the article is perpendicular (or substantially perpendicular) to the opening of the storage space upon entry into the storage space. In the horizontal-entry state, the opening of the storage space fits the length (longest distance between edges) of the article (e.g., smartphone, eyeglasses). The horizontal-entry state of the article (e.g., smartphone, eyeglasses) is such that, upon entry into the opening of the storage space, the article is in a horizontal-entry position/state such that the length of the article corresponds to the greatest length of the opening.

Figure 13B:
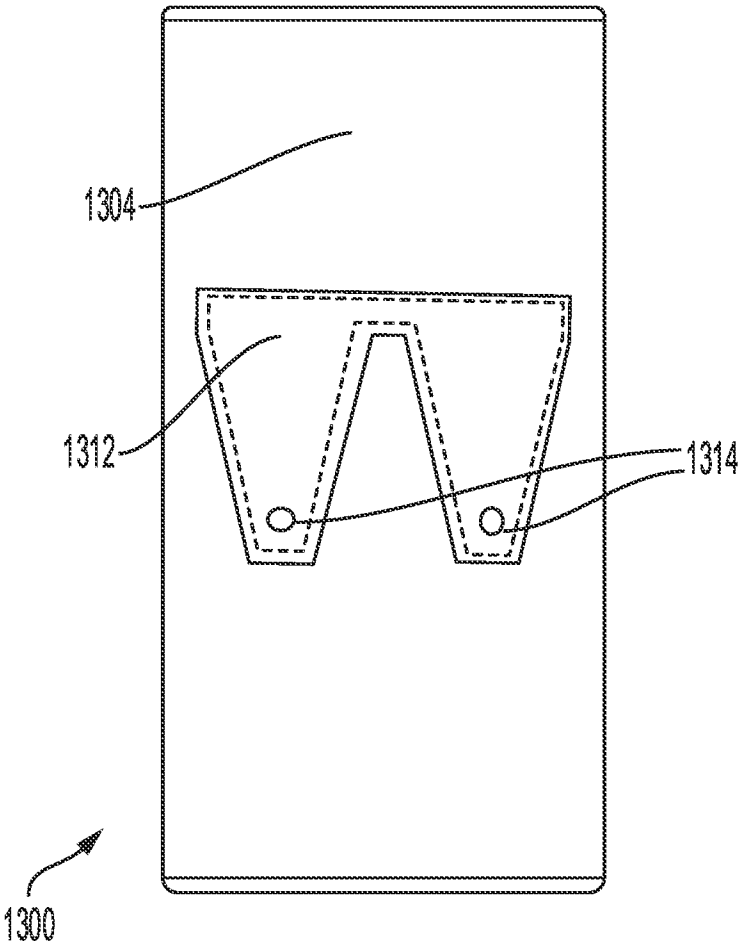
FIGS. 13A and 13B illustrate a vertical-entry eyeglasses case, according to an embodiment of the disclosure.
Figure 13A:
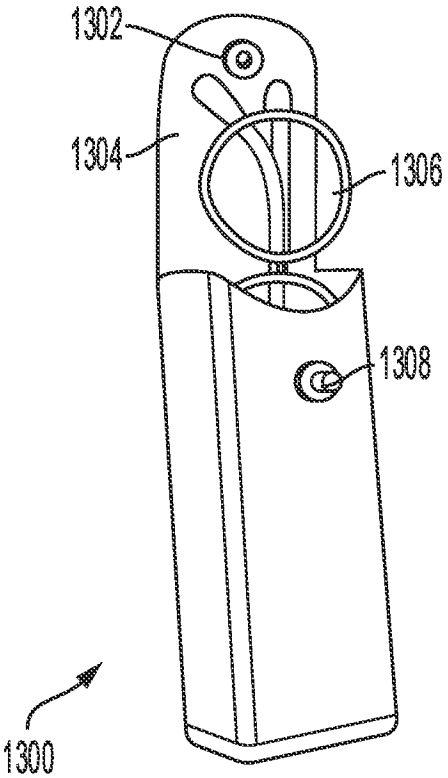

FIGS. 13A and 13B illustrate a vertical-entry eyeglasses case 1300, according to an embodiment of the disclosure. FIG. 13A illustrates a front view of the vertical-entry eyeglasses case 1300 and FIG. 13B illustrates a back/rear view of the vertical-entry eyeglasses case 1300, according to an embodiment. While explaining the carrying case according to embodiments of the disclosure, a detailed description of the contents overlapping with the carrying case according to the embodiments will be omitted. Referring to FIG. 13A, the vertical-entry eyeglasses carrying case 1300 may include a main body housing (see explanation of main body housing 9, as an example) but have a different size or the same size and it may have a different position and/or size of the opening as the main body housing 9. The vertical-entry eyeglasses carrying case 1300 may include a moveable part 1304 (see explanation of movable part 12, as an example), and a first fastening means 1302 (see explanation of first fastening means **12*a*, as an example) provided (e.g., attached to or embedded in) a first (front, or opening) side of the main body housing. Eyeglasses 1306, which may be referred to as an article or object, are shown in FIG. 13A in a vertical-entry orientation/state while being inserted into the opening of the storage space of the main body housing of the eyeglasses carrying case 1300. The first fastening means 1302 may include a female button 1302 (see explanation of female button 12*a*, as an example) and a male button 1308 (see explanation of male button 124, as an example). According to embodiments of the disclosure, fastening means (e.g., the first or second) may refer to the button coupling structure, including two buttons, or it may refer to another two-part fastening structure, such as two magnets that attract to each other, or two pieces of Velcro® that attach to each other. The male and female buttons can be swapped (i.e., the male button is where the female button is positioned, and the female button is where the male button is positioned). Referring to FIG. 13B, the vertical-entry eyeglasses carrying case 1300 may include a 1312 (see explanation of engaging part 110 as an example) and a second fastening means 1314 (e.g., the second fastening means 1314 shows a snap (female) button 1314 that corresponds to the snap (female) button 122 of the second fastening means 122, 124, and the second fastening means 1314 corresponds to the second fastening means and/or button-coupling structure 122, 124)). The second fastening means 1314 may be provided on a back/rear side 1304 of the main body housing of the vertical-entry eyeglasses carrying case 1300**.

Figure 14B:
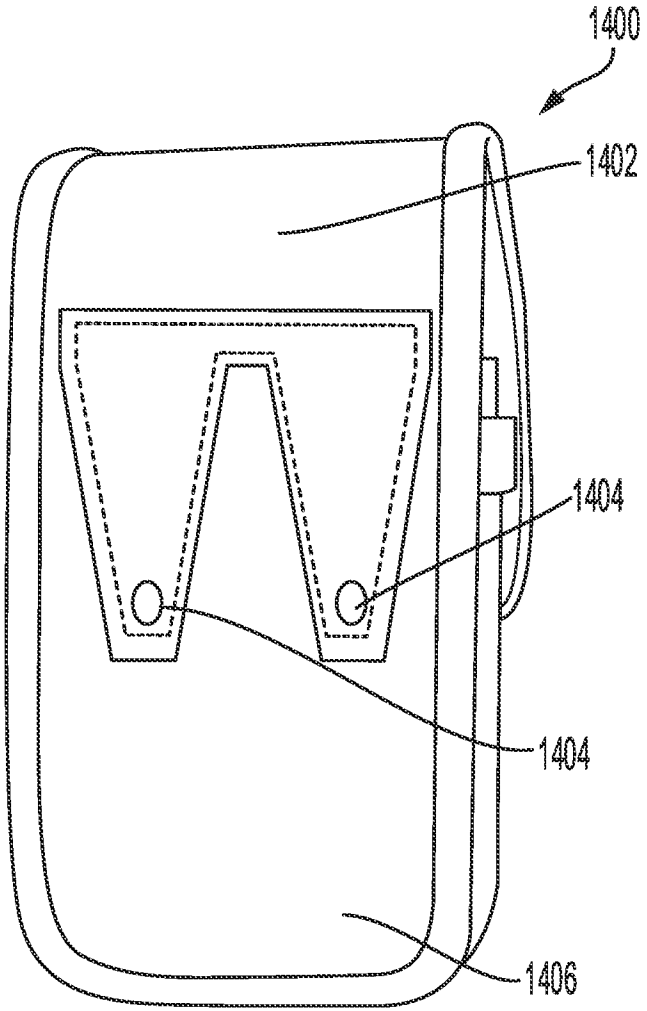
FIGS. 14A and 14B illustrate a vertical-entry smartphone case 1400, according to an embodiment of the disclosure.
Figure 14A:
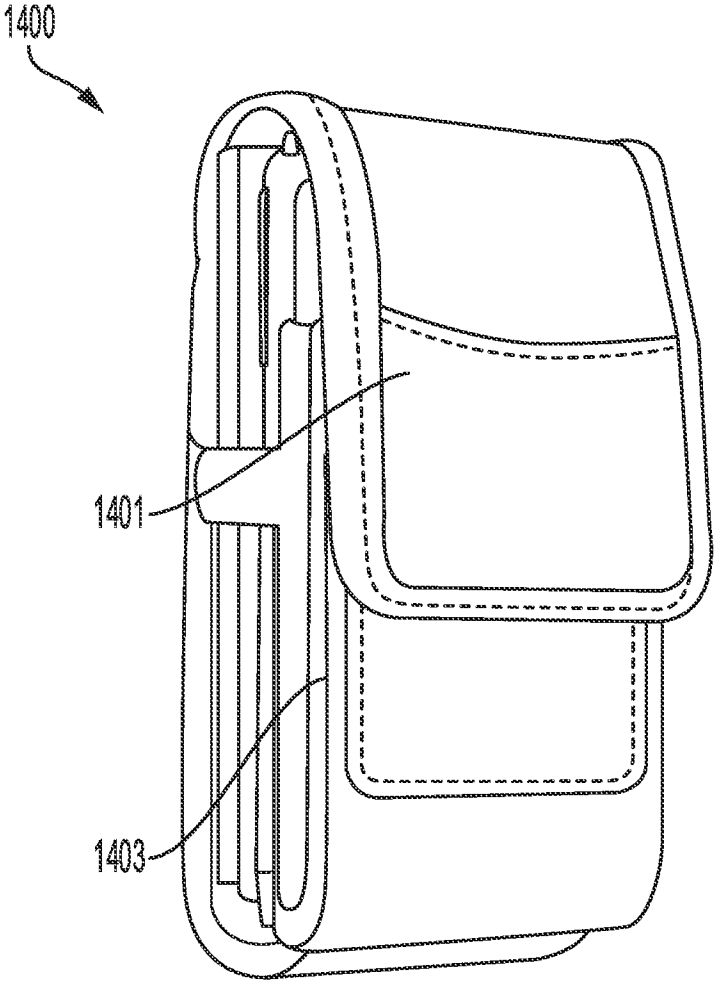

FIGS. 14A and 14B illustrate a vertical-entry smartphone case 1400, according to an embodiment of the disclosure. FIG. 14A illustrates a front view of the smartphone case 1400 and FIG. 14B illustrates a back view of the smartphone case 1400, according to an embodiment.

While explaining the carrying case according to embodiments of the disclosure, a detailed description of the contents overlapping with the carrying case according to the embodiments will be omitted. Referring to FIG. 14A, the vertical-entry smartphone carrying case 1400 may include a main body housing (see explanation of main body housing 9, as an example) but have a different size or the same size and it may have a different position and/or size of the opening as the main body housing 9. The vertical-entry smartphone carrying case 1400 may include a moveable part 1401 (see explanation of movable part 12, as an example), and a first fastening means (see explanation of first fastening means **12*a*, as an example) provided (e.g., attached to or embedded in) a first (front, or opening) side 1403 of the main body housing. The first fastening means of the vertical-entry smartphone carrying case 1400 may be hidden by the moveable part 1401, as shown in FIG. 14A. A Smartphone, which may be referred to as an article or object, may be inserted in a vertical orientation like the vertical-entry orientation/state of the eyeglasses shown in FIG. 13A while being inserted into the opening of the storage space of the main body housing of the smartphone carrying case 1400. The first fastening means may include a female button (see explanation of female button 12***a*, as an example) and a male button (see explanation of male button 124, as an example). According to embodiments of the disclosure, fastening means (e.g., the first or second) may refer to the button coupling structure, including two buttons, or it may refer to another two-part fastening structure, such as two magnets that attract to each other, or two pieces of Velcro® that attach to each other. The male and female buttons can be swapped (i.e., the male button is where the female button is positioned, and the female button is where the male button is positioned).

Referring to FIG. 14B, the vertical-entry smartphone carrying case 1400 may include an engaging part (see explanation of engaging part 110 as an example) with second fastening means 1404 (e.g., the second fastening means 1404 shows snap (female) buttons 1404 that corresponds to the snap (female) button 122 of the second fastening means 122, 124, and the second fastening means 1404 corresponds to the second fastening means and/or button-coupling structures 122, 124)). The second fastening means 1404 may be provided on a back/rear side 1406 of the main body housing of the vertical-entry smartphone carrying case 1400.

The smartphone may be any size or shape, although rectangular (with or without curved corners) is popular. Further, the smartphone may be any type of electronic device including but not limited to a calculator, a personal-digital assistant, a pager, a smartwatch, or the like.

Figure 14D:
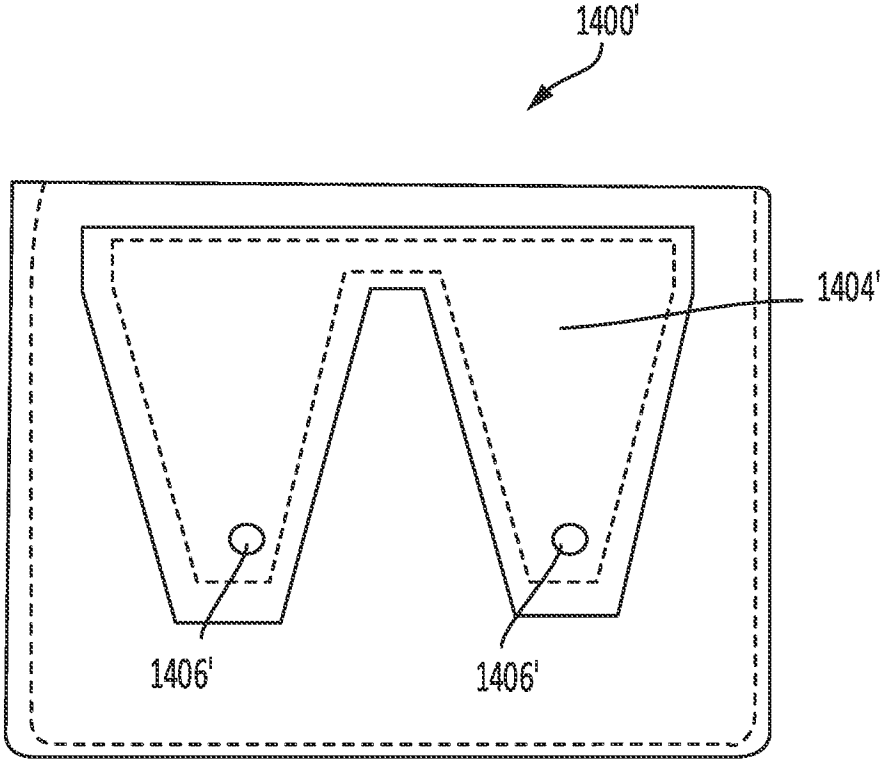
FIGS. 14C and 14D illustrate a horizontal-entry smartphone case, according to an embodiment of the disclosure.
Figure 14C:
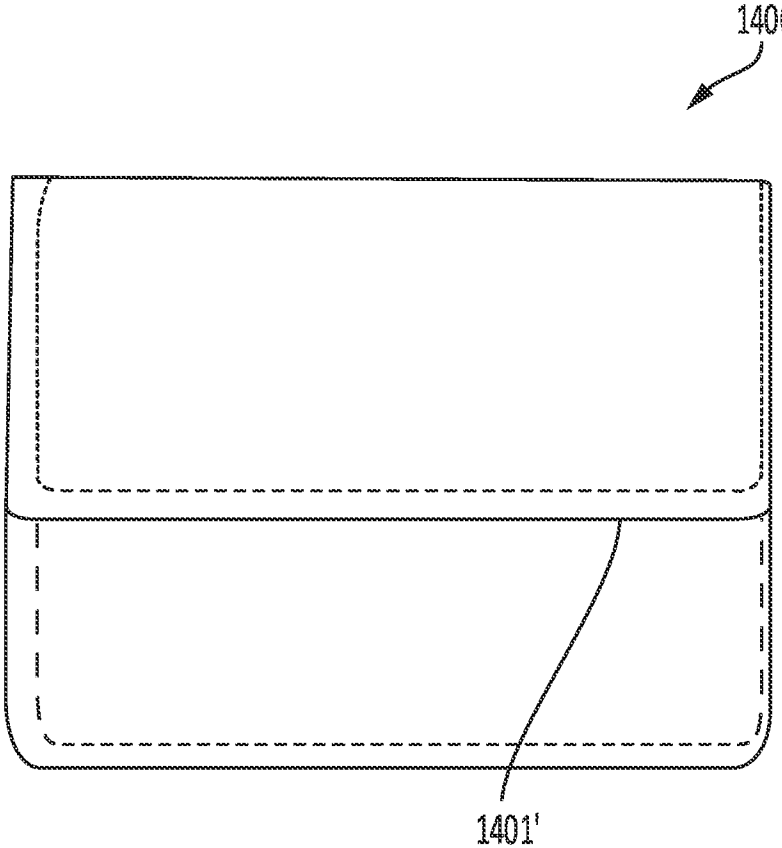

FIGS. 14C and 14D illustrate a horizontal-entry smartphone case 1400', according to an embodiment of the disclosure. FIG. 14C illustrates a front view of the horizontal-entry smartphone case 1400' and FIG. 14D illustrates a back/rear view of the horizontal-entry smartphone case 1400', according to an embodiment.

While explaining the carrying case according to embodiments of the disclosure, a detailed description of the contents overlapping with the carrying case according to the embodiments will be omitted. Referring to FIG. 14C, the horizontal-entry smartphone carrying case 1400' may include a main body housing (see explanation of main body housing 9, as an example) but have a different size or the same size and it may have a different position and/or size of the opening as the main body housing 9. The horizontal-entry smartphone carrying case 1400' may include a moveable part 1401' (see explanation of movable part 12, as an example), and a first fastening means (see explanation of first fastening means 12*a*, as an example) provided (e.g., attached to or embedded in) on a first (front, or opening) side (shown in FIG. 14C) of the main body housing. The first fastening means of the horizontal-entry smartphone carrying case 1400' may be hidden by the moveable part 1401', as shown in FIG. 14C. A Smartphone, which may be referred to as an article or object, may be inserted in a horizontal orientation similar to the horizontal-entry orientation/state of the eyeglasses in FIG. 2 while being inserted into the opening of the storage space of the main body housing of the smartphone carrying case 1400'. The first fastening means may include a female button (see explanation of female button 12*a*, as an example) and a male button (see explanation of male button 124, as an example). According to embodiments of the disclosure, fastening means (e.g., the first or second) may refer to the button coupling structure, including two buttons, or it may refer to another two-part fastening structure, such as two magnets that attract to each other, or two pieces of Velcro® that attach to each other. The male and female buttons can be swapped (i.e., the male button is where the female button is positioned, and the female button is where the male button is positioned).

Referring to FIG. 14D, the horizontal-entry smartphone carrying case 1400' may include an engaging part 1404' (see explanation of engaging part 110 as an example) with second fastening means 1406' (e.g., the second fastening means 1406' shows snap (female) buttons 1406' that corresponds to the snap (female) button 122 of the second fastening means 122, 124, and the second fastening means 1406' corresponds to the second fastening means and/or button-coupling structures 122, 124)). The second fastening means 1406' may be provided on a back/rear side of the main body housing of the horizontal-entry smartphone carrying case 1400'.

Figure 15C:
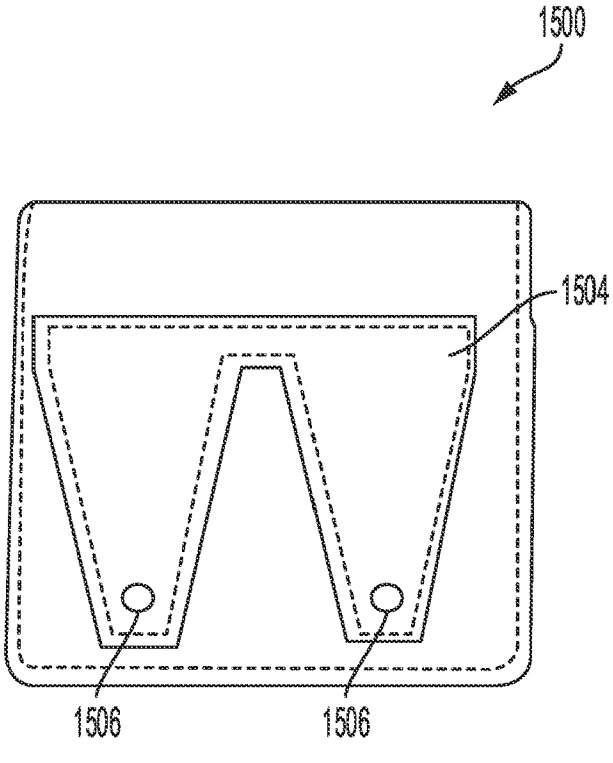
FIGS. 15A-C illustrate a horizontal-entry golf range finder case 1500, according to an embodiment of the disclosure.
Figure 15B:
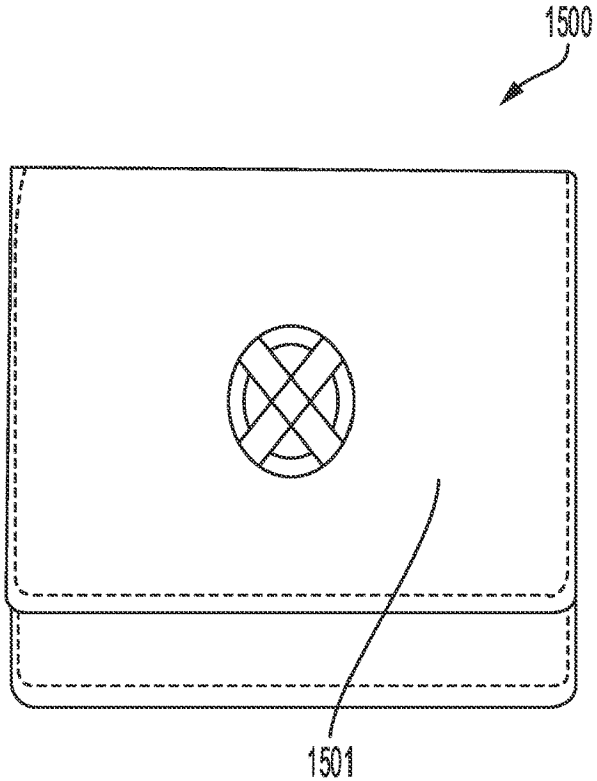
Figure 15A:
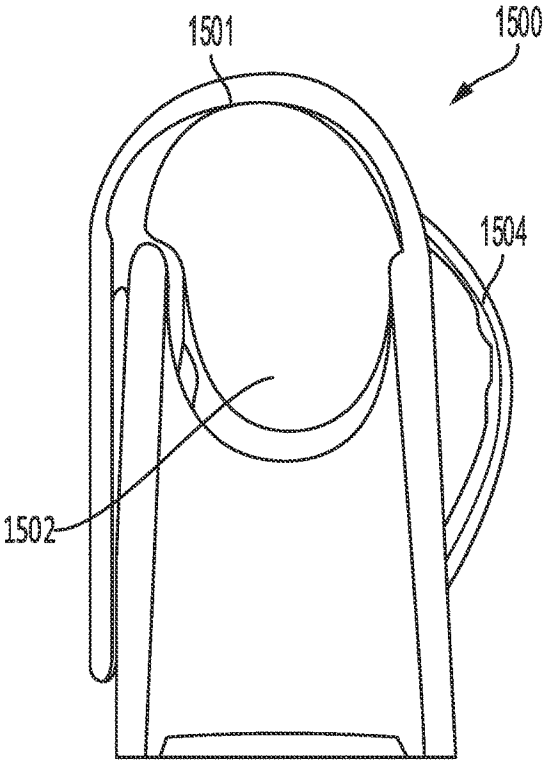

FIGS. 15A-C illustrate a horizontal-entry golf range finder case 1500, according to an embodiment of the disclosure. FIG. 15A illustrates a side view of the horizontal-entry golf range finder case 1500, FIG. 15B illustrates a front view of the golf range finder case 1500, and FIG. 15C illustrates a back view of the golf range finder case 1500. Although a horizontal-entry golf range finder case is shown, a vertical-entry golf range finder case could correspond a previously-described vertical-entry orientation.

While explaining the carrying case according to embodiments of the disclosure, a detailed description of the contents overlapping with the carrying case according to the embodiments will be omitted. Referring to FIG. 15A and FIG. 15B, the horizontal-entry golf range finder carrying case 1500 may include a main body housing (see explanation of main body housing 9, as an example) but have a different size or the same size and it may have a different position and/or size of the opening as the main body housing 9. The horizontal-entry golf range finder carrying case 1500 may include a moveable part 1501 (see explanation of movable part 12, as an example), and a first fastening means (see explanation of first fastening means 12*a*, as an example) provided (e.g., attached to or embedded in) on a first (front, or opening) side (shown in FIG. 15B) of the main body housing. The first fastening means of the horizontal-entry golf range finder carrying case 1500 may be hidden by the moveable part 1501, as shown in FIG. 15B. A Golf range finder, which may be referred to as an article or object, may be inserted in a horizontal orientation like the horizontal-entry orientation/state of the eyeglasses in FIG. 2 while being inserted into the opening of the storage space of the main body housing of the golf range finder carrying case 1500. The first fastening means may include a female button (see explanation of female button 12*a*, as an example) and a male button (see explanation of male button 124, as an example). According to embodiments of the disclosure, fastening means (e.g., the first or second) may refer to the button coupling structure, including two buttons, or it may refer to another two-part fastening structure, such as two magnets that attract to each other, or two pieces of Velcro® that attach to each other. The male and female buttons can be swapped (i.e., the male button is where the female button is positioned, and the female button is where the male button is positioned). The horizontal-entry golf range finder carrying case 1500 may include a viewport 1502 so that the golf range finder may have an unobstructed view to the outside (e.g., to see a golf course).

Referring to FIG. 15B, the horizontal-entry golf range finder carrying case 1500 may include an engaging part 1504 (see explanation of engaging part 110 as an example) with second fastening means 1506 (e.g., the second fastening means 1506 shows snap (female) buttons 1506 that corresponds to the snap (female) button 122 of the second fastening means 122, 124, and the second fastening means 1506 corresponds to the second fastening means and/or button-coupling structures 122, 124)). The second fastening means 1506 may be provided on a back/rear side of the main body housing of the horizontal-entry golf range finder carrying case 1500.

Figure 16A:
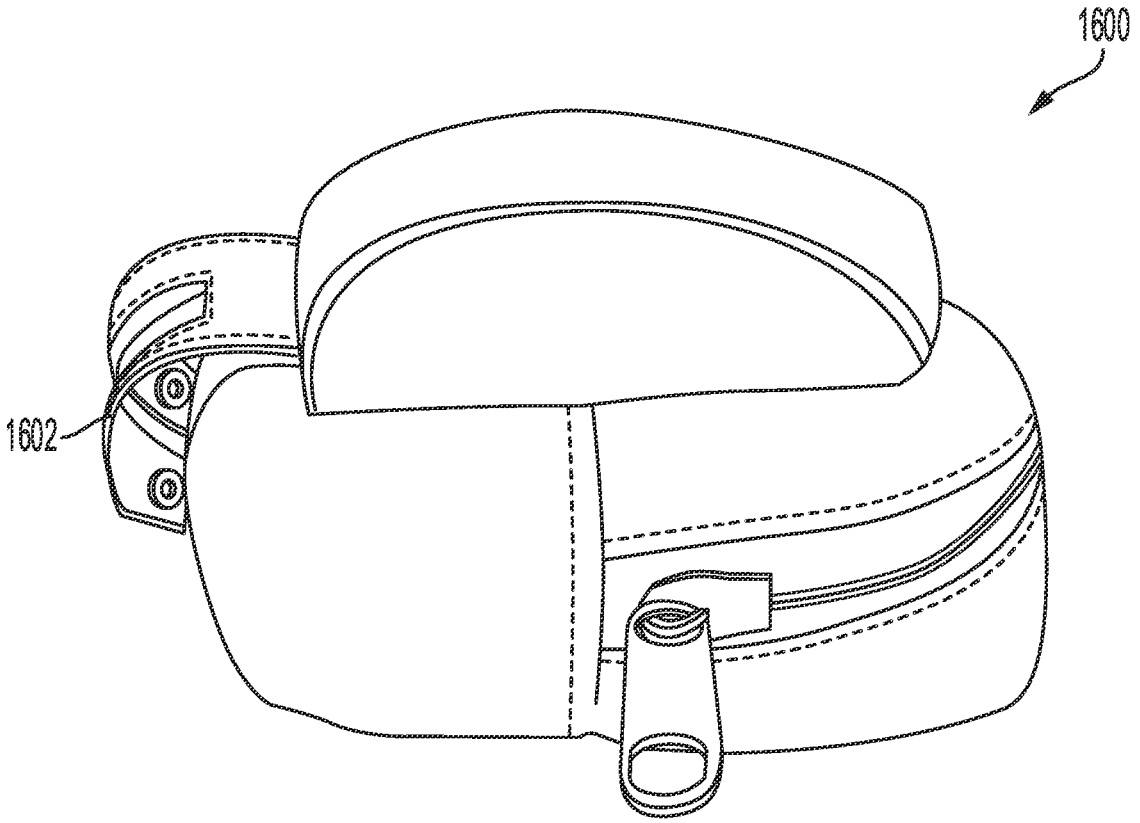
FIGS. 16A and 16B illustrate a golf ball carrier case 1600, according to an embodiment of the disclosure.
Figure 16B:
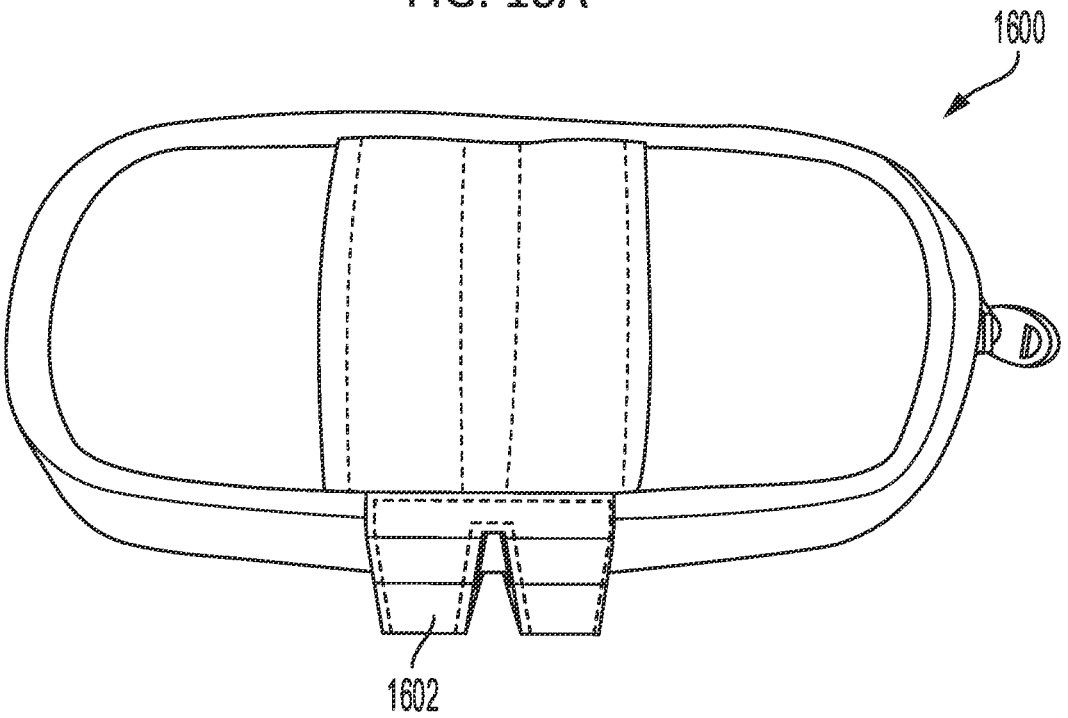

FIGS. 16A and 16B illustrate a golf ball carrier case 1600, according to an embodiment of the disclosure. FIG. 16A illustrates a front view of the golf ball carrier case 1600 and FIG. 16B illustrates a back view of the golf ball carrier case 1600, according to an embodiment.

While explaining the carrying case according to embodiments of the disclosure, a detailed description of the contents overlapping with the carrying case according to the embodiments will be omitted. Referring to FIG. 16A and FIG. 16B, the golf ball carrying case 1600 may include a main body housing (see explanation of main body housing 9, as an example) but have a different size or the same size and it may have a different position and/or size of the opening as the main body housing 9. The golf ball carrying case 1600 may include a moveable part 1601 (see explanation of movable part 12, as an example), and a first fastening means (see explanation of first fastening means 12*a*, as an example) provided (e.g., attached to or embedded in) on a first (front, or opening) side (shown in FIG. 16B) of the main body housing. The first fastening means of the golf ball carrying case 1600 may be a zipper that connects two portions of the main body housing of the golf ball carrying case 1600 together, as shown in FIG. 15B. A golf ball, which may be referred to as an article or object, may be inserted into the opening of the storage space of the main body housing of the golf ball carrying case 1600. Although a zipper is shown, the first fastening means may include a female button (see explanation of female button 12*a*, as an example) and a male button (see explanation of male button 124, as an example). According to embodiments of the disclosure, fastening means (e.g., the first or second) may refer to a zipper coupling structure, the button coupling structure, including two buttons, or it may refer to another two-part fastening structure, such as two magnets that attract to each other, or two pieces of Velcro® that attach to each other. The male and female buttons can be swapped (i.e., the male button is where the female button is positioned, and the female button is where the male button is positioned).

Referring to FIG. 16B, the golf ball carrying case 1600 may include an engaging part 1602 (see explanation of engaging part 110 as an example) with second fastening means (e.g., the second fastening means shows snap (female) buttons that corresponds to the snap (female) button 122 of the second fastening means 122, 124, and the second fastening means corresponds to the second fastening means and/or button-coupling structures 122, 124)). The second fastening means may be provided on a back/rear side of the main body housing of the golf ball carrying case 1600.

Figure 17B:
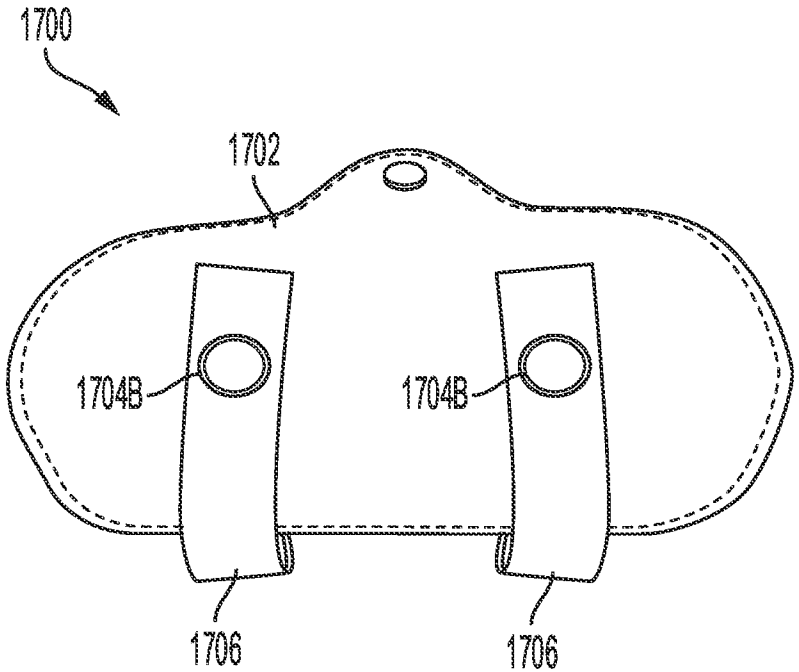
FIGS. 17A and 17B illustrate a carrying case with modified loop portions, according to an embodiment of the disclosure.
Figure 17A:
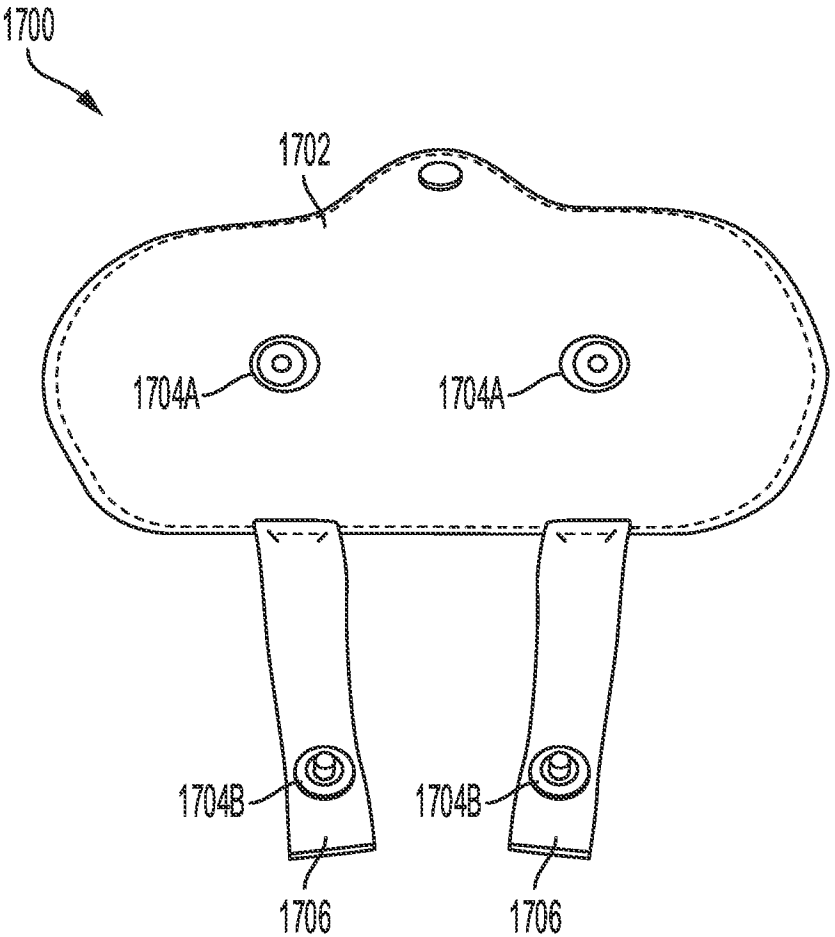

FIGS. 17A and 17B illustrate an eyeglasses carrying case 1700 according to an embodiment. The eyeglasses carrying case 1700 is a single strap design (e.g., no stitching, no trapezoidal shape). While explaining the carrying case according to embodiments of the disclosure, a detailed description of the contents overlapping with the carrying case according to the embodiments will be omitted. Although the carrying case 1700 is designed for eyeglasses, other articles described above may be used and the carrying case 1700 may be modified to accommodate those other articles. FIGS. 17A and 17B are for the situations of using simple straight line rectangle straps 1706 as the one or more partially-detachable loop portion(s) 1706 instead of using trapezoidally-elongated shape of straps 120, 120*a* as the partially-detachable loop portion(s) 120, 120*a*.

A contact area is a glued and stitched area between the back of the eyeglass case and the straps. A contact force is the force existing at the contact area (e.g., putting and/or making contact at the glued and stitched area) between the back of the eyeglass carrying case and the straps 1706. A wider/larger contact area (e.g., straps 120, 120*a* in FIG. 1) has a stronger contact force than the narrower straps 1706 in FIGS. 17A and 17B. The narrower/smaller the contact area, the weaker the contact force. The contact area between the back side of the eyeglasses carrying case 1700 and the simple straight line rectangle straps 1706, as shown in FIGS. 17A and 17B, is much smaller or not wider at all than the contact area between the back of eyeglasses case 100 and trapezoidally-elongated shape of straps 120, 120*a*. The contact force between the back of eyeglasses case 1700 and the simple straight line rectangle straps 1706, as shown in FIGS. 17A and 17B, is much weaker or not stronger at all than the contact force between the back of eyeglasses case 100 and trapezoidally elongated shape of straps 120, 120*a*. The back of eyeglasses case 100 and trapezoidally elongated shape of straps 120, 120*a* provides two benefits over the design of FIGS. 17A and 17B, including a better durability (e.g., less deformation from wear and tear; less worn-out or loosened contact area), and less self-twisting of straps, which could be problematic. In the real-life day-to-day situations, it is a lot easier to use with stronger contact force of the eyeglass case with trapezoidally elongated shape of straps than the eyeglass case with simple straight-line straps.

While explaining the carrying case according to embodiments of the disclosure, a detailed description of the contents overlapping with the carrying case according to the embodiments will be omitted. Referring to FIG. 17A and FIG. 17B, the eyeglasses carrying case 1700 may include a main body housing (see explanation of main body housing 9, as an example) but have a different size or the same size and it may have a different position and/or size of the opening as the main body housing 9. The eyeglasses carrying case 1700 may include a moveable part 1702 (see explanation of movable part 12, as an example), and a first fastening means (see explanation of first fastening means 12*a*, as an example) provided (e.g., attached to or embedded in) on the rear/back side 1702 of the main body housing.

Eyeglasses, which may be referred to as an article or object, may be inserted in a horizontal orientation like the horizontal-entry orientation/state of the eyeglasses shown in FIG. 1 while being inserted into the opening of the storage space of the main body housing of the eyeglasses carrying case 1700. The first fastening means may include a female button (see explanation of female button 12*a*, as an example) and a male button (see explanation of male button 124, as an example). According to embodiments of the disclosure, fastening means (e.g., the first or second) may refer to the button coupling structure, including two buttons, or it may refer to another two-part fastening structure, such as two magnets that attract to each other, or two pieces of Velcro® that attach to each other. The male and female buttons can be swapped (i.e., the male button is where the female button is positioned, and the female button is where the male button is positioned).

Referring to FIGS. 17A and 17B, the eyeglasses carrying case 1700 may include an engaging part 1706 (see explanation of engaging part 110 as an example) with second fastening means 1704A, 1704B (e.g., the second fastening means 1704A shows snap (female) buttons 1704A that corresponds to the snap (female) button 122 of the second fastening means 122, 124, and the second fastening means 1704A, 1704B may correspond to the second fastening means and/or button-coupling structures 122, 124)). The second fastening means 1704A, 1704B may be provided on a back/rear side of the main body housing of the eyeglasses carrying case 1700.

Although exemplary embodiments have been shown and described, the disclosure is not limited thereto, and various modifications and variations are possible within the scope of the appended drawings and the detailed description. For example, embodiments or elements of various embodiments, can be applied not only to the glasses carrying case, but also to a cell phone/smartphone carrying case, a golf range finder carrying case, or a case for storing golf ball(s), each of which falls within the scope of the present invention. It will be appreciated by those skilled in the art that changes may be made in these exemplary embodiments without departing from the principles and spirit of the general inventive concept, the scope of which is defined in the appended claims and their equivalents.

The invention claimed is:

1. A carrying case comprising:

a main body housing providing a storage space within the main body housing, wherein the main body housing provides an opening to make the storage space accessible, a movable part or flap attached to or integrally provided by the main body housing along a longitudinal direction of a first surface of the main body housing;

two partially-detachable loop portions each attached to an outer surface of the main body housing, wherein the movable part or flap is configured to move between an open position and a closed position, the storage space is accessible from the outside when the movable part or flap is in the open position, and an object placed within the storage space is prevented from leaving the storage space when the movable part or flap is in the closed position; and two fastening means, wherein each of the two partially-detachable loop portions includes a fastening means, each of the two partially-detachable loop portions has a first end that is fixedly-attached to the main body housing and that is in an attached position outside of the storage space, and that is provided outside of the main body housing at the outer surface of the main body housing, and a second end that is attachable/detachable to the main body housing by way of the respective one of the two fastening means, wherein each of the two fastening means is attachable/detachable to a corresponding fastening means provided on an outer surface of the main body housing by an operation using one human or animal hand, and, wherein, in a fully-attached state, each of the two fastening means holds the second end of the respective partially-detachable loop portion to the outer surface of the main body housing to form a closed loop until the respective fastening means is released, the releasing allowing a partially-detachable loop portion to move to a partially-attached state where the second end freely moves and the closed loop is opened, wherein the two partially-detachable loop portions have a trapezoidally-elongated shape that grows narrower from the first end to the second end to stabilize the storage space to prevent shaking of any contents within the storage space, and to prevent twisting of the two partially-detachable loop portions, while minimizing interference with a belt during attachment/detachment, wherein the opening of the flap is in an opposite direction as the opening of the two partially-detachable loop portions.

2. The carrying case of claim 1, wherein the respective first end of each of the two partially-detachable loop portions and the respective second end of each of the two partially-detachable loop portions are provided on a same side of the outer surface of the main body housing.

3. The carrying case of claim 1, wherein the two partially-detachable loop portions are spaced apart such that a belt loop of pants can fit between the two partially-detachable loop portions, the belt loop being configured to prevent the belt from falling.

4. The carrying case of claim 1, wherein the at least one fastening means comprise at least one of: a male button, a female button, a hook strip of a hook and loop fastener, a loop strip of a hook and loop fastener, or a magnet.

5. The carrying case of claim 1, wherein the at least one fastening means comprises a button coupling structure including a first fastening means portion corresponding to a male button or a female button, and a second fastening means portion on the outer surface of the main body housing, the second fastening means portion comprising the other one of the male button or the female button.

6. The carrying case of claim 1, further comprising eyeglasses or a smartphone stored in the storage space, wherein inner surfaces of the storage space within the main body housing are configured to hold the eyeglasses or smartphone while preventing the eyeglasses or smartphone from leaving the storage space.

7. The carrying case of claim 6, wherein the opening to the storage space is fitted and configured to allow entry and exit of the eyeglasses or smartphone into the storage space, the storage space is substantially rectangular, and the opening to the storage space is provided along a short side of the substantially rectangular storage space.

8. The carrying case of claim 6, wherein the opening to the storage space is fitted and configured to allow entry and exit of the eyeglasses or smartphone into the storage space, the storage space is substantially rectangular, and the opening to the storage space is provided along a long side of the substantially rectangular storage space.

9. The carrying case of claim 1, wherein when in the fully-attached state, each of the two partially-detachable loop portions close a loop around a belt strap of a belt outside of the storage space.

10. The carrying case of claim 1, wherein the two partially-detachable loop portions each comprise a reinforcing part that prevents shape deformation of the two partially-detachable loop portions.

11. The carrying case of claim 10, wherein each reinforcing part comprises a sewing reinforcement structure that is at least one of: stapled, glued, and/or sewn, and/or a stich pattern.

12. The carrying case of claim 1, wherein one or more of the two partially-detachable loop portions is made of a leather, a synthetic leather material or a nylon canvas.

13. A carrying case comprising:

a housing providing a storage space within the carrying case, a movable part or flap attached to the housing;

a re-enforce contacting part strip attached to the housing on an outer surface of the housing;

two loop portions; and a part of an attachable/detachable fastening means attached to one end of each of the two loop portions, wherein the housing provides an opening to make the storage space accessible, the movable part or flap is configured to move between an open position and a closed position, the storage space is accessible from the outside when the movable part or flap is in the open position, an article placed within the housing is prevented from leaving the storage space when the movable part or flap is in the closed position, wherein a first end of each of the two loop portions is fixedly-attached to the re-enforced contacting part strip, and a second end of each of the two loop portions is attachable/detachable to a fastening means provided on the outer surface of the housing to hold the second end of a respective loop portion in an attached position, wherein the loop portion is configured to be held by a belt when the loop portion is in the attached position and the respective loop portion surrounds a belt strap of the belt, wherein the reinforced contacting part strip is formed in a strip shape along the longitudinal direction of the housing; and wherein the two partially-detachable loop portions have a trapezoidally-elongated shape that grows narrower from the first end to the second end.

14. The carrying case of claim 13, wherein the contacting part strip is formed on a rear side of the housing, the movable part or flap attaches/detaches to a front side of the housing, and the rear side is on an opposite side of the housing as the front side.

15. The carrying case of claim 13, wherein the contacting part strip is integrally coupled to the housing through a stitched sewing pattern and an adhesive.

16. An eyeglasses carrying case comprising:

a main body housing providing a storage space within the main body housing;

a pair of eyeglasses housed within the main body housing;

a movable part or flap attached to or integrally provided by the main body housing;

two partially-detachable loop portions each attached to an outer surface of the main body housing; and two fastening means, wherein the main body housing provides an opening to make the storage space accessible, the opening to the storage space is fitted and configured to allow entry and exit of the eyeglasses into the storage space;

the movable part or flap is configured to move between an open position and a closed position, the storage space is accessible from the outside when the movable part or flap is in the open position, an object placed within the storage space is prevented from leaving the storage space when the movable part or flap is in the closed position, each of the two partially-detachable loop portions includes a fastening means, each of the two partially-detachable loop portions has a first end and a second end, the first end is fixedly-attached to the main body housing, is in an attached position outside of the storage space, and is provided outside of the main body housing at the outer surface of the main body housing, the second end is attachable/detachable to the main body housing by way of the respective one of the two fastening means, each of the two fastening means is attachable/detachable to a corresponding fastening means provided on an outer surface of the main body housing, and in a fully-attached state, each of the two fastening means holds the second end of the respective partially-detachable loop portion to the outer surface of the main body housing to form a closed loop until the respective fastening means is released/detached, the releasing allowing a partially-detachable loop portion to move to a partially-attached state where the second end freely moves and the closed loop is opened; and wherein the two partially-detachable loop portions have a trapezoidally-elongated shape that grows narrower from the first end to the second end.

17. The carrying case of claim 13, wherein the opening to the storage space is fitted and configured to allow entry and exit of the eyeglasses or smartphone into the storage space, the storage space is substantially rectangular, and the opening to the storage space is provided along a short side of the substantially rectangular storage space.

18. The carrying case of claim 13, wherein the opening to the storage space is fitted and configured to allow entry and exit of the eyeglasses or smartphone into the storage space, the storage space is substantially rectangular, and the opening to the storage space is provided along a long side of the substantially rectangular storage space.

* * * * *